US006412539B1

(12) United States Patent
Kuribayashi et al.

(10) Patent No.: US 6,412,539 B1
(45) Date of Patent: Jul. 2, 2002

(54) DRIVE ASSEMBLY FOR OPENING AND CLOSING A ROLLING DOOR

(75) Inventors: Takanobu Kuribayashi; Yasushi Yamamoto; Wataru Nakatsuka, all of Tokyo; Hiroshi Miyanokoshi, Jushiyama-mura, all of (JP)

(73) Assignee: Sanwa Shutter Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/463,886

(22) PCT Filed: Mar. 23, 1998

(86) PCT No.: PCT/JP98/01226

§ 371 (c)(1),
(2), (4) Date: Apr. 25, 2000

(87) PCT Pub. No.: WO99/02987

PCT Pub. Date: Feb. 25, 1999

(30) Foreign Application Priority Data

Aug. 2, 1997 (JP) ..... 9/239083
Feb. 20, 1998 (JP) ..... 10/56146

(51) Int. Cl.[7] ..... A47G 5/02

(52) U.S. Cl. ..... 160/310; 160/133; 160/330; 160/383

(58) Field of Search ..... 160/133, 310, 160/330, 382, 383, 395, 396, 397, 400, 401, 402, 403

(56) References Cited

U.S. PATENT DOCUMENTS 1,559,531 A * 10/1925 Yehle ..... 160/383
3,285,089 A * 11/1966 Tsugawa ..... 160/133
3,614,370 A * 10/1971 Italo ..... 219/69 E
3,853,167 A * 12/1974 Wardlaw ..... 160/133
4,231,411 A * 11/1980 Hehl et al. ..... 160/120
4,258,778 A * 3/1981 Upton et al. ..... 160/383
4,394,561 A * 7/1983 Zerbel ..... 219/285
4,403,415 A * 9/1983 Kufrin ..... 30/96
4,590,814 A * 5/1986 Wadensten ..... 74/87
4,626,190 A * 12/1986 Hellmer ..... 425/539
4,723,070 A * 2/1988 Sikora et al. ..... 219/535
5,188,492 A * 2/1993 McCraken ..... 409/182
5,397,950 A * 3/1995 Norbury, Jr. et al. ..... 310/91
6,055,885 A * 5/2000 Shea ..... 74/625
6,092,582 A * 7/2000 Liu ..... 160/310

FOREIGN PATENT DOCUMENTS

JP 535997 5/1993
JP 08240087 9/1996

* cited by examiner

*Primary Examiner*—Bruce A. Lev
(74) *Attorney, Agent, or Firm*—Christensen O'Connor Johnson Kindness pllc

(57) ABSTRACT

An opening and closing device for an architectural rolling door is provided in which various parts of the device are assembled into a cylindrical-shaped casing with good work efficiency and without looseness. After a casing (6) is divided into upper and lower semi-cylindrical parts (9, 10) and various parts, such as an electric motor (12), of the device are assembled into the lower semi-cylindrical part (10), the upper semi-cylindrical part(9) is slidingly fitted into and assembled to the lower part (10) and flange portions **(9*c*, 10*d*) on the upper and the lower parts (9, 10) in this state are clamped to each other and fixed in a state in which the casing (6)** is made small in diameter.

14 Claims, 25 Drawing Sheets

PRIOR ART (A)

DRIVE ASSEMBLY FOR OPENING AND CLOSING A ROLLING DOOR

TECHNICAL FIELD

This invention relates to a drive assembly for a rolling door that opens and closes an opening of a building such as an office building or factory.

BACKGROUND OF THE INVENTION

A drive assembly for the rolling door such as an architectural shutter generally comprises components including driving means such as an electric motor or a manually driving device, a speed reducer, and a brake mechanism for preventing a rotation of an output shaft that might include a motor shaft.

The drive assembly should be protected by a casing so as not to be damaged by contacting other members at the time of installation of the drive assembly. Thus, as shown in FIG. 13, each component constituting the drive assembly is individually covered by a casing C and is installed one by one with fastening means such as a bolt. According to this configuration, the installation of components is bothersome and complicated, and the number of members constituting the drive assembly increases because each casing accommodating each member should be required.

Japanese Utility Model publication No.5- 35997 discloses a cylindrical casing which houses members constituting the drive assembly. According to this casing, an electric motor of the drive assembly includes a bare stator core that should be fixed to the casing. To fix the stator core to the casing, the cylindrical casing is heated to increase an internal diameter, and the components including the electric motor are inserted to the casing in the expanded state. Then the casing is cooled to room temperature to reduce the internal diameter so that those components are fixed inside the casing. According to this method, heating equipment is required and the components must be installed in the casing quickly before the heated casing is cooled.

Further, when installing the components into the cylindrical casing having a circular internal surface, if the assembly includes a reduction gear that transmits a driving force from a motor shaft of the electric motor to an output shaft for example, the positioning of the reduction gear and the output shaft must be properly and precisely done and the positioned components must be inserted into the heated casing.

An object of the present invention is to preclude those disadvantages.

SUMMARY OF THE INVENTION

There is provided a drive assembly for opening and closing a rolling door that comprises a cylindrical casing accommodating drive assembly components. The casing has spaced apart opposed edge portions to define a gap therebetween to form a gap portion in a natural state in which the natural state means a state without applying any external forces. The drive assembly includes fastening means for narrowing the gap between the opposed edge portions such that the drive assembly components are aligned and fixed inside the casing by fastening the gap portion.

This construction precludes the bothersome operation that includes heating the casing to expand the diameter and inserting the components to the heated casing. Further, this construction permits fixing drive assembly components without looseness. Preferably, the gap portion provided in the casing extends in an orthogonal direction to the radial direction of the casing.

The casing may be comprised of a pair of semi-cylindrical parts having opposed edge portions. One opposed the edge portions constitute engaging portions that are detachably engaged to each other. The other opposed edge portions constitute the gap portion in the natural state in which the engaging portions are engaged.

The opposed edge portions defining the gap portion may have flanges extending outwardly in the radial direction, and the fastening means for narrowing the gap portion is provided in the flanges.

The drive assembly may be comprised of a plurality of units that have substantially the same outer diameter as an inner diameter of the casing. Each shaft is automatically centralized when a first bracket and a second bracket are fixed to the casing. The units are engaged to each other and installed in the casing.

The assembly may include a unit that constitutes a gear portion reducing a motor driving force and outputting a force. The unit comprises a motor shaft, a gear shaft having a reduction gear, an output shaft, a first bracket which journals the motor shaft and one end of the gear shaft, and a second bracket which journals the output shaft and the other end of the gear shaft. An external diameter of the both brackets is substantially the same as the internal diameter of the casing. The motor shaft, the gear shaft and the driving shaft are aligned and centralized by reducing the diameter of the casing. Each shaft is automatically aligned when a first bracket and a second bracket are fixed to the casing.

The first and the second brackets may have protruding portions in outer surfaces and the casing may have a groove engaging the protruding portions. The first and the second brackets are temporarily positioned by the engagement of the protruding portions and the groove, and shafts are to be aligned by reducing the diameter of the casing.

PREFERRED EMBODIMENTS FOR CARRYING OUT THE INVENTION

Figure 1:
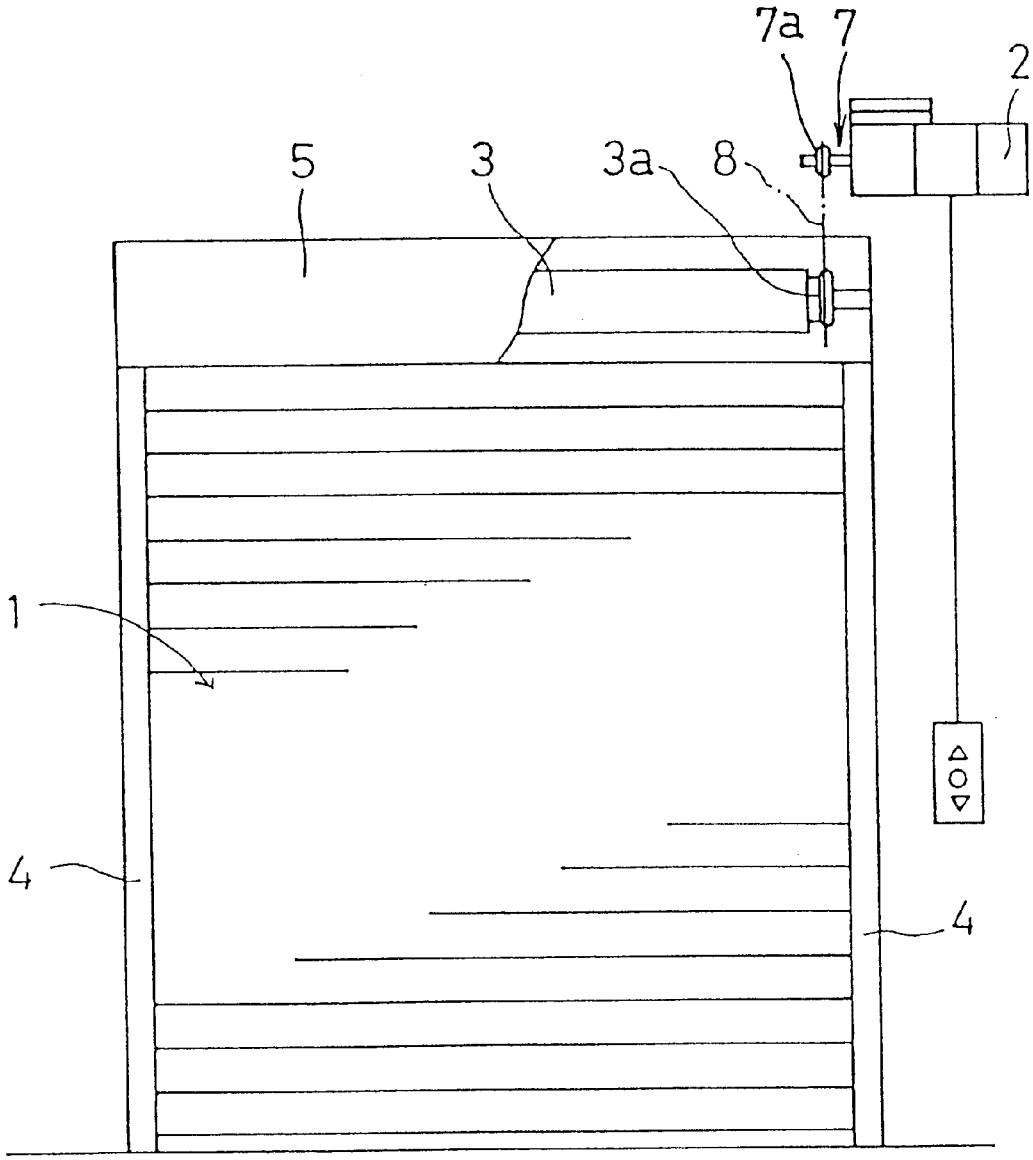
FIG. 1 shows a front view of the shutter assembly.
Figure 2:
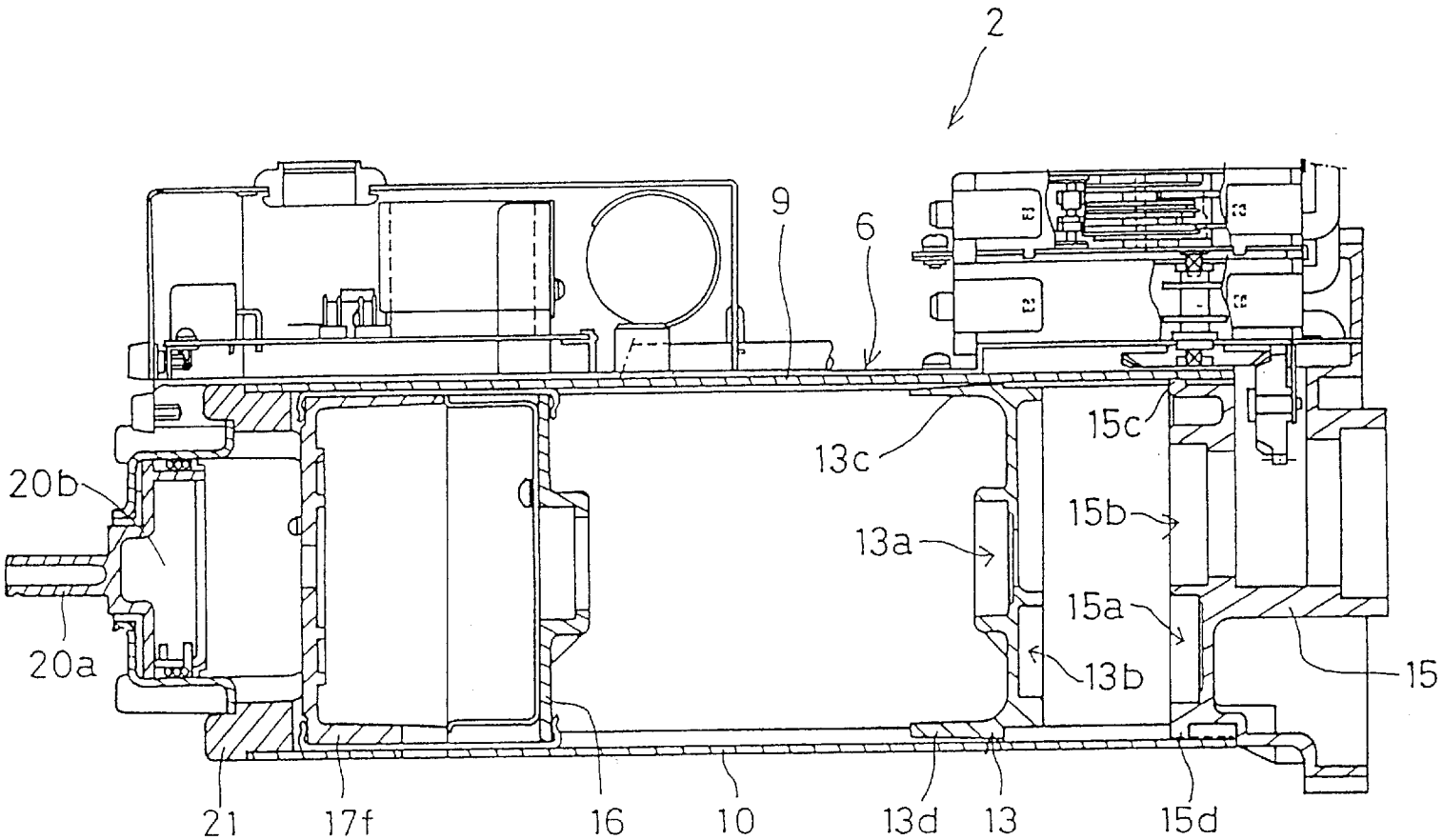
FIG. 2 is a sectional view showing a casing with brackets installed.
Figure 3:
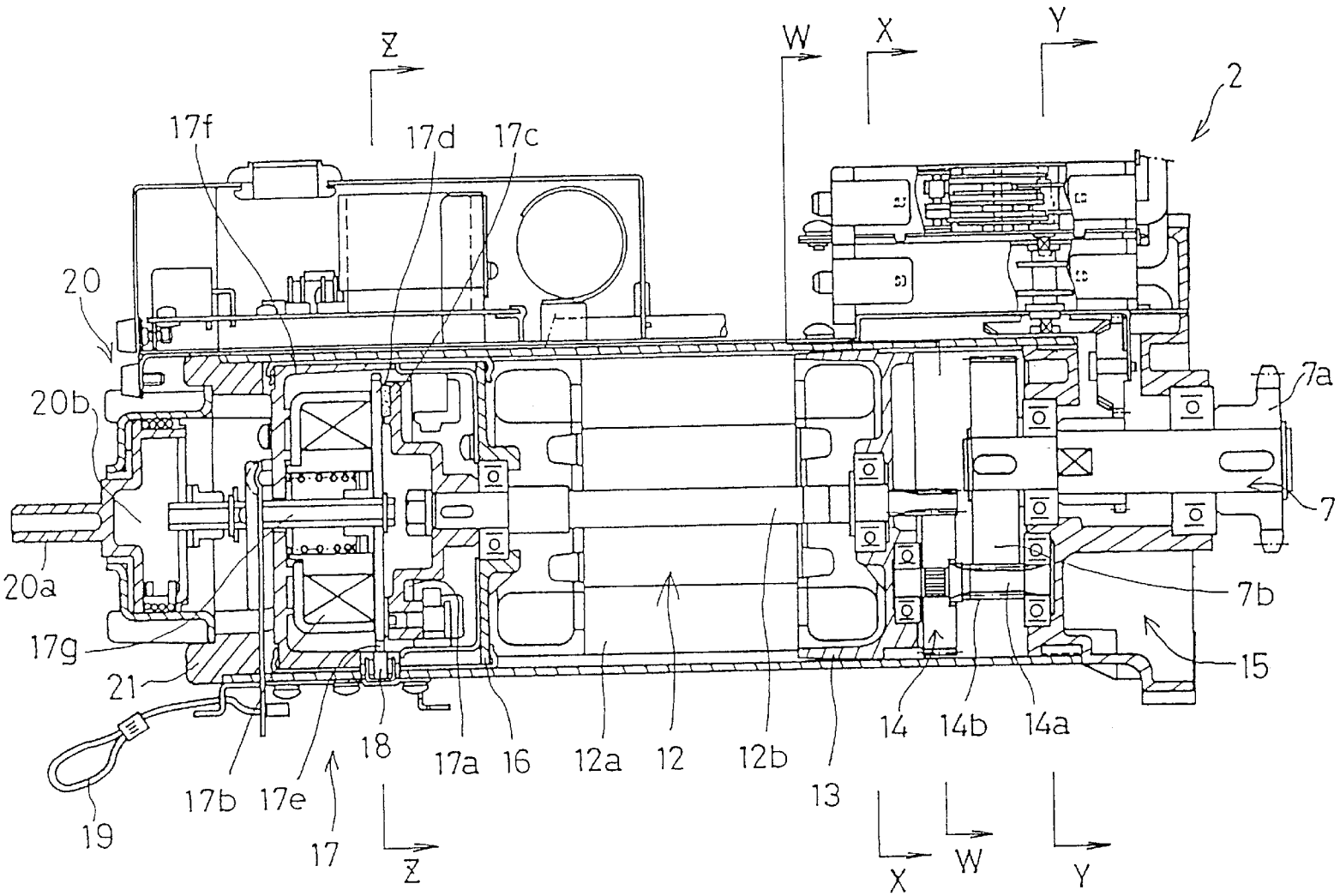
FIG. 3 is a sectional view of a drive assembly.
Figure 4:
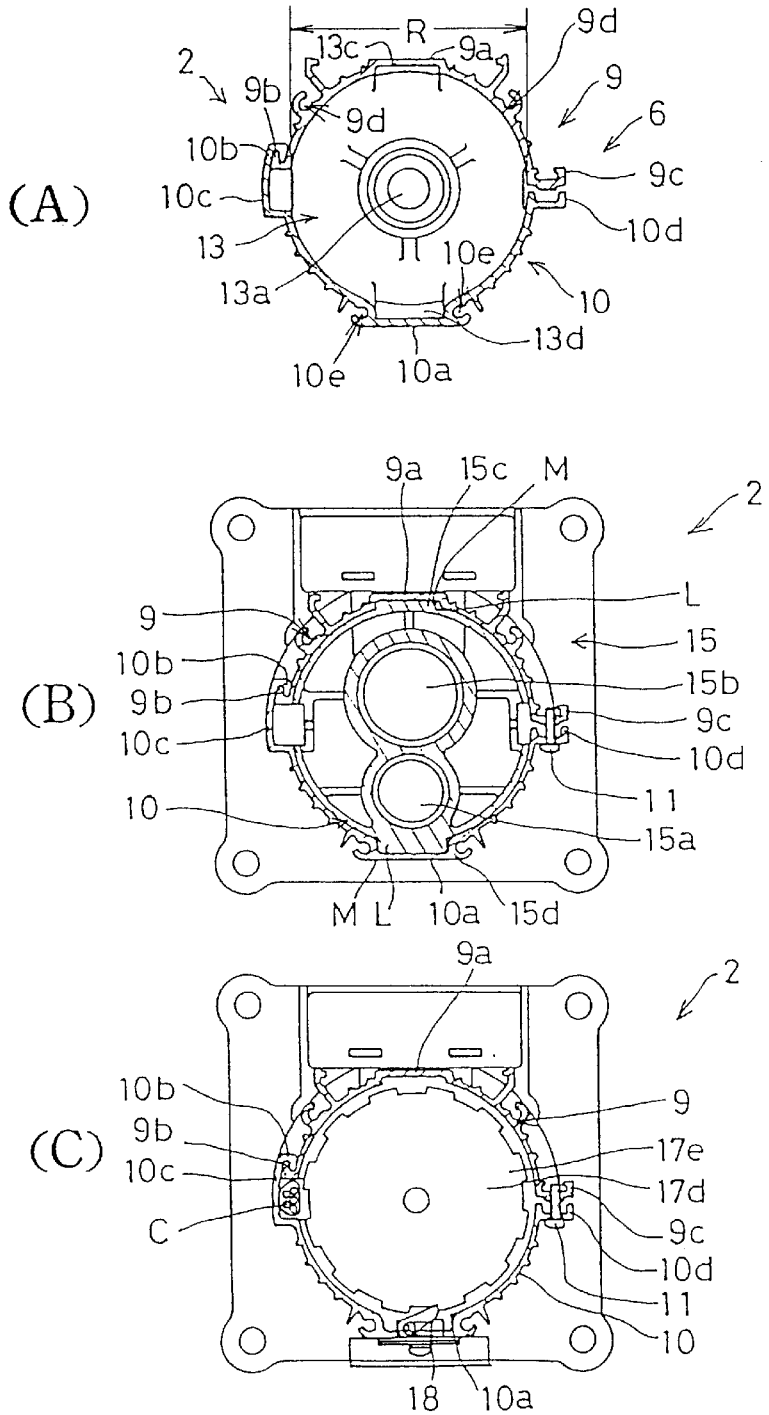
FIG. 4(A) shows a section taken along the line X—X of FIG. 3.
FIG. 4(B) shows a section taken along the line Y—Y of FIG. 3.
FIG. 4(C) shows a section taken along the line Z—Z of FIG. 3.
Figure 5:
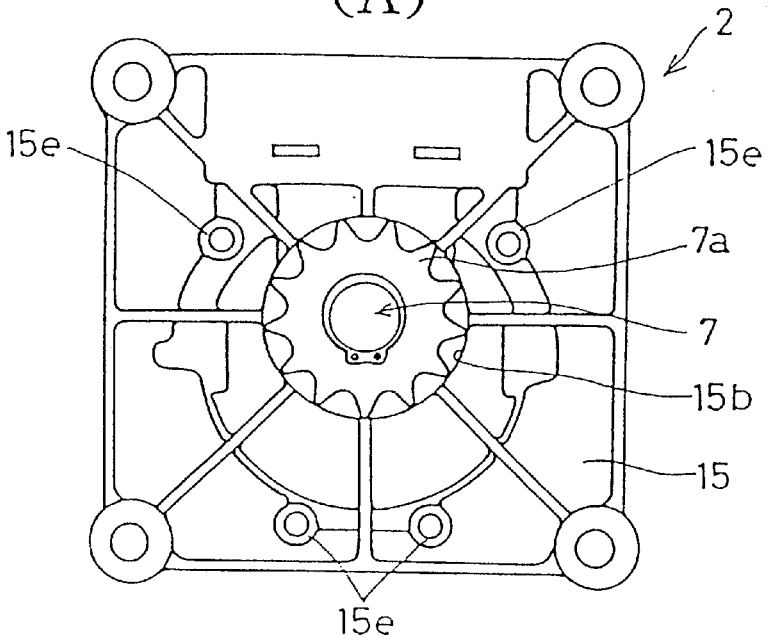
FIG. 5(A) shows a right side view of FIG. 3.
FIG. 5(B) shows a section taken along the line W—W of FIG. 3.
Figure 5:
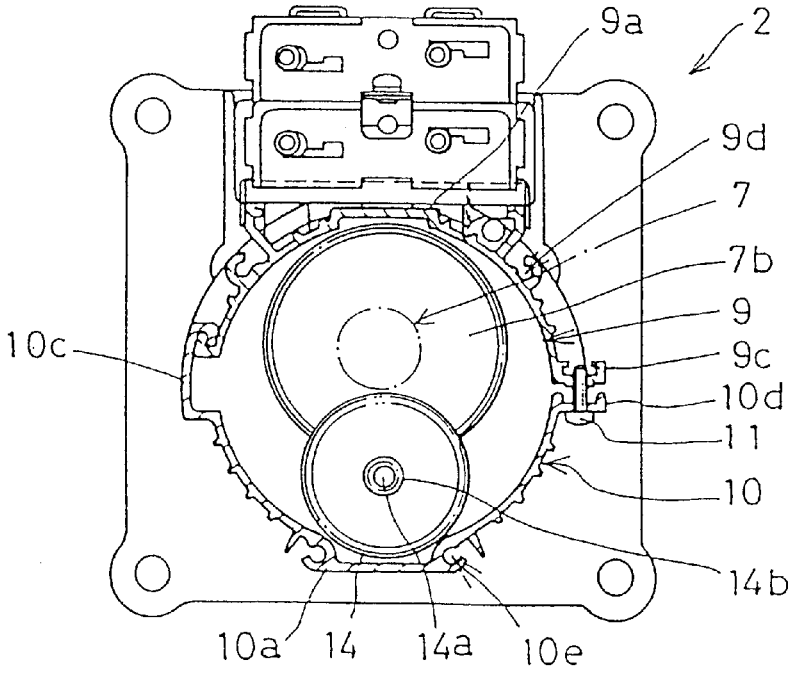
Figure 6:
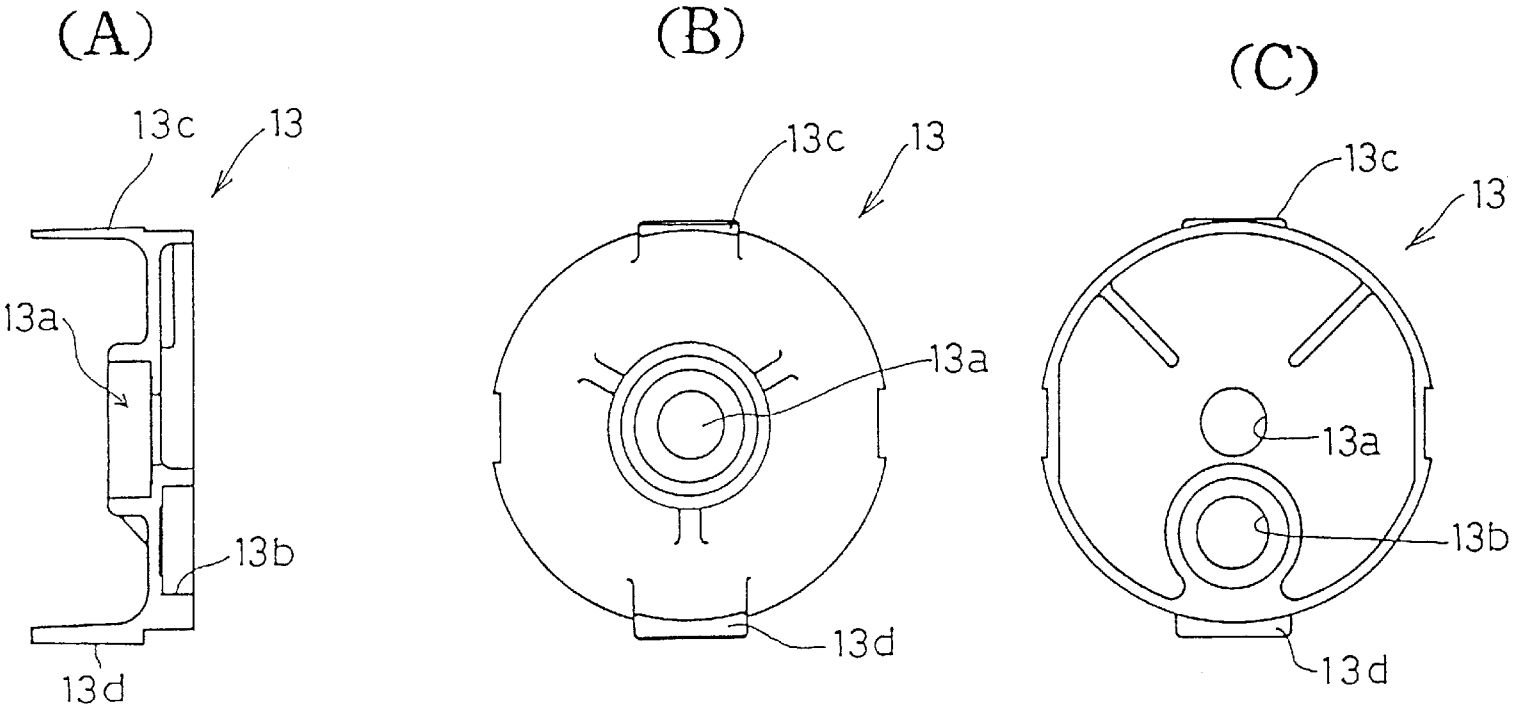
FIG. 6(A) shows a front view of a first bracket.
FIG. 6(B) shows a right side view of the first bracket.
FIG. 6(C) shows a left side view of the first bracket.
Figure 7:
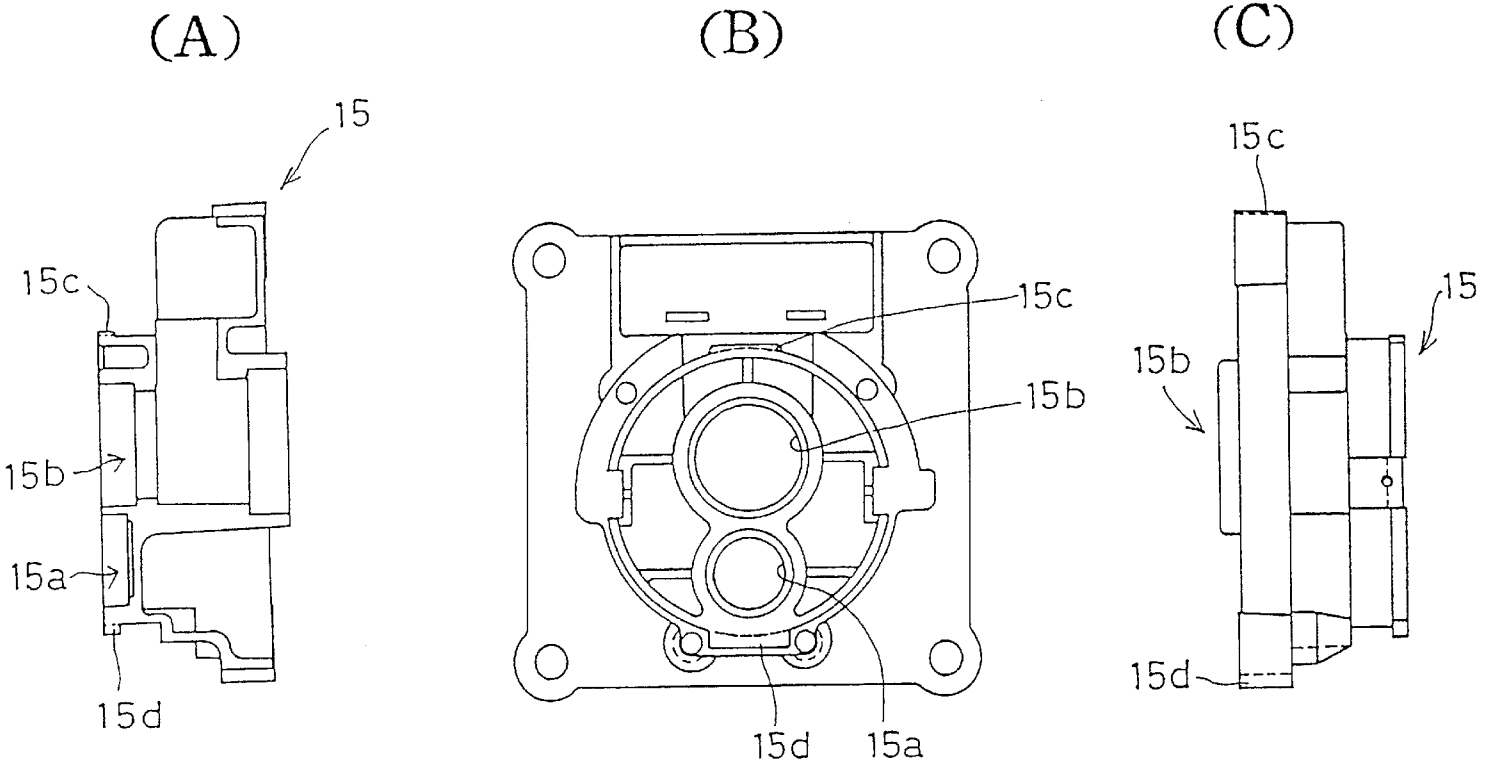
FIG. 7(A) shows a front view of the second bracket.
FIG. 7(B) shows a right side view of the second bracket.
FIG. 7(C) shows a left side view of the second bracket.
Figure 8:
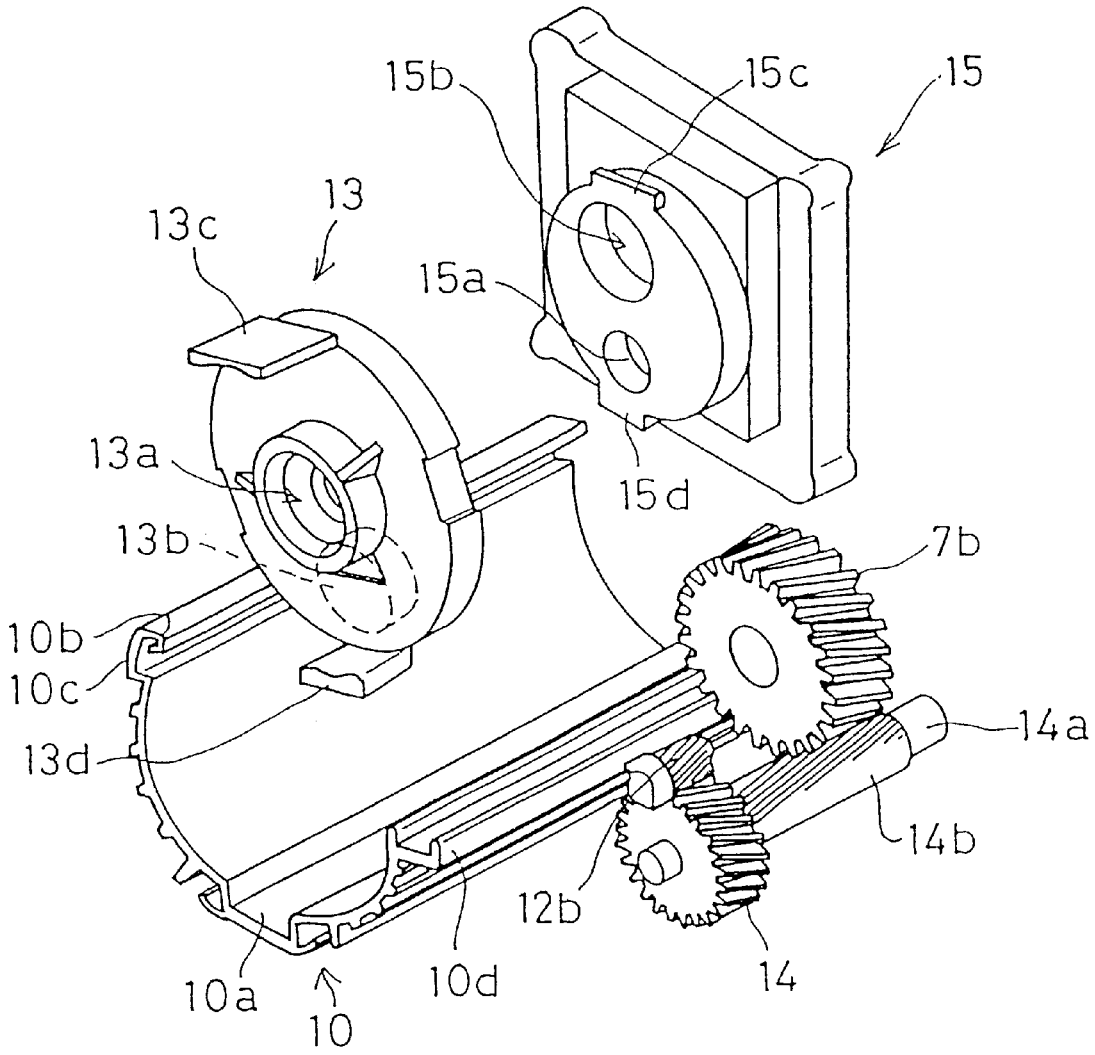
FIG. 8 shows a perspective view showing installation of the first bracket, the second bracket, a motor shaft, a reduce device and a driving shaft.
Figure 9:
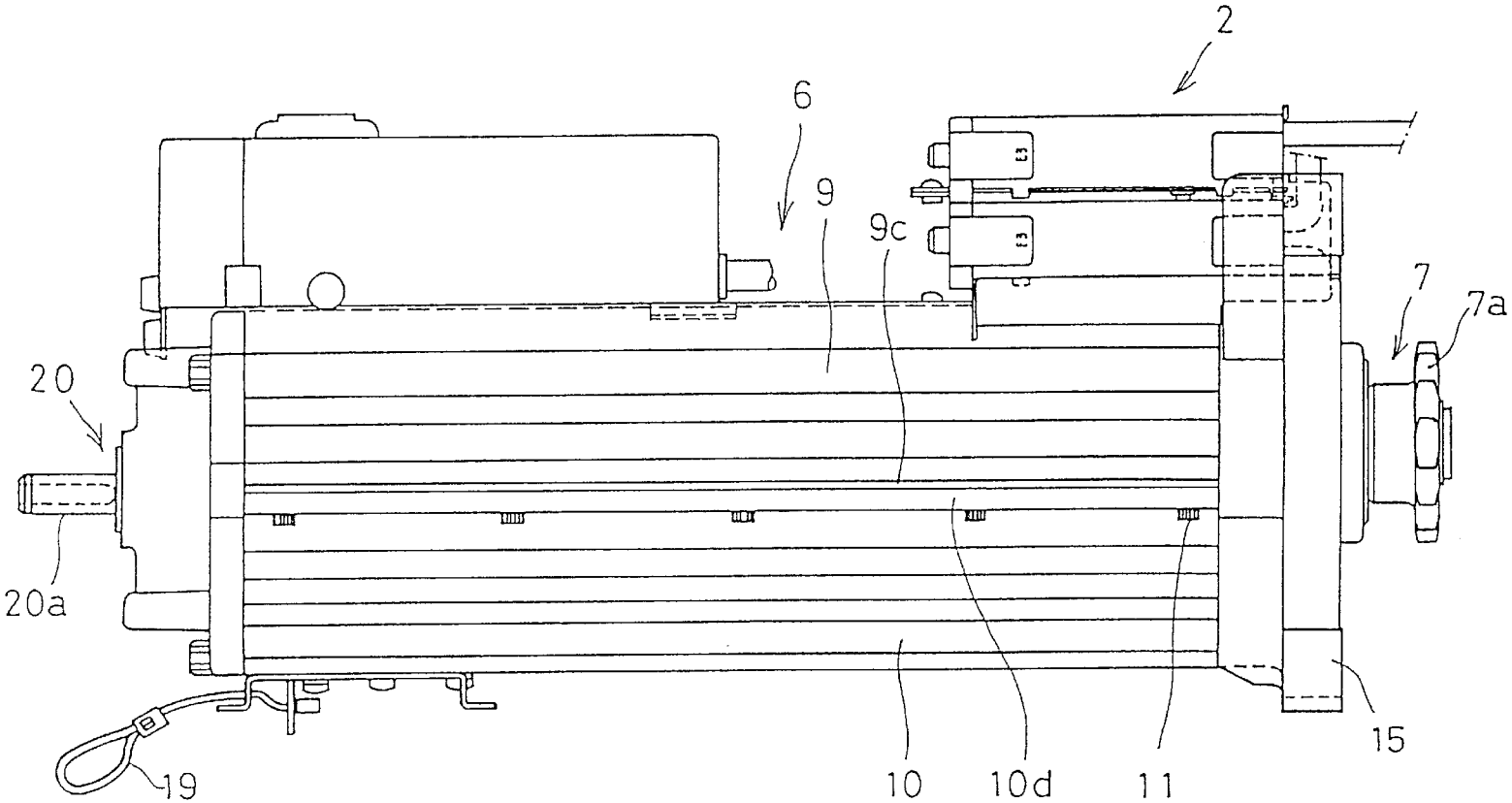
FIG. 9 shows a front view of the drive assembly.

A first embodiment of the present invention will be explained according to FIGS. 1 to 10. FIG. 1 is a front view of a shutter apparatus that opens and closes an opening of a building. A shutter curtain 1 is wound and unwound around a winding drum 3 that is connected to a drive assembly 2. The shutter curtain 1 is wound and unwound to open and close the opening in accordance with a reversible rotation of the winding drum 3. Upstanding guide tracks 4 guiding side portions of the shutter curtain 1 are provided at side portions of the opening. A shutter case 5 that accommodates the drive assembly 2 and the winding drum 3 is provided above the opening.

A cylindrical casing 6 is fixed to a building body with its longitudinal direction substantially parallel to the winding drum 3. The casing 6 accommodates a plurality of components constituting the drive assembly 2. An output shaft 7 is rotatably projected from one end of the cylindrical casing 6 and an output shaft sprocket 7*a* is provided at the output shaft 7. A sprocket 3*a* is projected from one end of the winding drum 3. The driving force of the drive assembly 2 is transmitted to the winding drum 3 via a chain 8 that connects the sprocket 7*a* to the sprocket 3*a*.

The casing 6 has a predetermined internal diameter R (R=94mm in the embodiment) and is divided along the longitudinal direction into two halves. The casing 6 is comprised of an upper semi-cylindrical part 9 and a lower semi-cylindrical part 10. The upper semi-cylindrical part 9 is connected to the lower semi-cylindrical part 10 to cover an opening of the lower semi-cylindrical part 10 and to form the casing 6. The upper semi-cylindrical part 9 and the lower semi-cylindrical part 10 of the embodiment are made of aluminum extrusion. An upper portion of the upper semi-cylindrical part 9 is protruded in the radial direction to form a protruding portion 9*a*. A lower portion of the lower semi-cylindrical part 10 is protruded in the radial direction to form a protruding portion 10*a*. The protruding portion 9*a*, 10*a* are extended in the longitudinal direction of the casing 6 and form channels in the internal surface.

Connecting means for connecting the upper and lower semi-cylindrical parts 9, 10 to each other is provided integrally at two pairs of opposed edges of the upper and lower semi-cylindrical parts in the longitudinal direction of the casing. In one opposed edges of the semi-cylindrical parts 9, 10, the upper semi-cylindrical part 9 has an engaging portion 9*b* comprising a projecting edge and a downwardly bent portion. The lower semi-cylindrical part 10 has an engaging portion 10*b* comprising a projecting edge and an upwardly bent portion. As explained hereinafter, after incorporating the drive assembly in the lower semi-cylindrical part 10, the engaging portions 9*b*, 10*b* are slidably engaged to each other to prevent from disengaging in the radial direction.

The engaging portion 10*b* is formed on an upper portion of a projected portion 10*c* which is projected outwardly in the radial direction. A space is presented after a slide engagement of the semi cylindrical parts 9, 10 so that a cord c is housed in the space.

In the other pair of opposed edges, flanges 9*c*, 10*d* that are outwardly projected in the radial direction away from the casing are integrally formed. The flanges 9*c*, 10*d* are fastened to each other by using a plurality of screws 11 to obtain rigid fixation of the casing 6. The flanges 9*c*, 10*d* extending in the radial direction permit the fastening operation by screw 11 being done outside the casing so that cutting dust generated in the fastening operation is not entered inside the casing 6.

The upper and lower semi-cylindrical parts 9, 10 are formed of the aluminum extrusion so that the longitudinal length of the semi-cylindrical parts is easily adjusted. Thus, if the components incorporated in the casing 6 are changed, the length of the casing can be adjusted.

Process of installing the drive assembly components into the lower semi-cylindrical part 10 will be explained. In accordance with the first embodiment, a single driving assembly unit which is comprised of a motor 12, a first bracket 13, a first reduction gear 14, a second bracket 15, a third bracket 16 and the output shaft 7 is installed into the lower semi cylindrical part 10 from upper opening of the lower part 10. The drive assembly of the embodiment employs an electric motor 12 as a driving means in which an outer diameter of a stator core 12*a* corresponds to an inner diameter R of the cylindrical casing. The first bracket 13, the second bracket 15, and the third bracket 16 are formed from a disc-like member having substantially the same diameter as the inner diameter R of the casing 6.

The first bracket 13 is located at one end of the electric motor 12. One end of the motor shaft 12*b* is rotatably supported by a first supporting portion 13*a* of the first bracket 13 and the other end of the motor shaft 12*b* is rotatably supported by the third bracket 16. The first reduction gear 14 has a gear shaft 14*a* one end of which is rotatably supported by a first supporting portion 15*a* of the second bracket 15 which is located adjacent the gear 14. The other end of gear shaft 14*a* is rotatably supported by a second supporting portion 13*b* of the first bracket 13. The output shaft 7 which is a gear shaft of a second reduction gear 7*b* is rotatably supported by a second supporting portion 15*b* of the second bracket 15. The second gear 7*b* is geared to a pinion gear 14*b* formed on a surface of the gear shaft 14*a*. In sum, the motor shaft 12*b*, the first reduction gear 14 and output shaft 7 constitute an assembly unit in combination with the first, second and the third brackets 13, 15, 16.

In the upper and lower portions of the brackets 13, 15, there are integrally provided engaging projections 13*c*, 13*d*, 15*c*, 15*d* that engage the projections 9*a*, 10*a* of the semi-cylindrical portions 9, 10 respectively. The engaging projections permit temporarily positioning the brackets 13, 15 when installing the brackets 13, 15 into the lower semi-cylindrical part 10.

The first supporting portion 13*a*, the second supporting portion 13*b*, the first supporting portion 15*a*, and second supporting portion 15*b* of the first and second brackets 13, 15 are opposed to correspond with the opposed location of the upper and lower protruding portions 13*c*, 13*d*, 15*c*, 15*d*. When the first and second brackets are set in which the protruding portions 13*c*, 13*d*, 15*c*, 15*d* are opposed, the motor shaft 12*b*, the gear shaft 14*a*, and the output shaft 7 that are supported by the first and second brackets 13, 15 are automatically aligned.

A brake assembly 17 is installed at the other end of the motor shaft 12*b* that is projected from the third bracket 16. When the electric motor 12 is driven, a solenoid 17*b* is magnetized so that a brake plate 17*c* of the motor shafts 12*b* and a brake plate 17*d* of the solenoid 17*b* are spaced apart so that the motor shaft 12*b* can freely be driven. When the motor 12 is not driven, the solenoid 17*b* is not magnetized so that brake plates 17*c*, 17*d* are contacted so that the rotation of the motor shaft 12*b* is prevented. An outer surface of the brake plate 17*d* of the solenoid 17*b* has ratchet teeth 17*e* that are engaged with a ratchet 18 provided in the protruded portion 10*a* of the lower semi-cylindrical part 10. The ratchet 18 works and prevents rotation only if the brake plate 17*d* rotates toward the closing direction of the shutter curtain 1. When the electric motor 12 is not driven, the rotation of the motor shaft 12*b* in the opening direction of the shutter curtain is allowed. The positioning of the brake assembly 17 in the lateral direction relative to the casing 6 can be done by opposing the ratchet teeth 17*e* to the ratchet 18 when the solenoid 17*b* is in the non-magnetized condition.

A mechanism for rocking the rotation of the brake assembly 17 will be explained. The brake assembly 17 engages the motor shaft 12*b* only when the electric motor 12 is not driven so that the mechanism for preventing the rotation is not required. However, as will be explained hereafter, when the shutter curtain 1 is manually opened, the motor shaft 12*b* is rotated via the brake mechanism 17 so that the mechanism for preventing rotation should overcome a load that is exerted when the ratchet teeth 17*e* ride over the ratchet 18 in the opening direction. According to the embodiment, a casing 17*f* of the brake assembly 17 has an outer diameter that is substantially the same as the inner diameter of the casing 6 so that the brake assembly 17 is housed in the casing 6 without presenting any spaces to prevent rotating.

The brake assembly 17 comprises a release cord 19 by which the shutter curtain 1 can be closed in case of an electric failure for example. When the cord 19 is pulled, the brake plates 17*c*, 17*d* are spaced apart. The brake assembly 17 and the manually release mechanism are known.

A manually driving assembly 20 is installed at the other end of the brake assembly 17. The assembly 20 has an input shaft 20*a* that is connected to a manually operation member (not shown). A fourth bracket 21 is interposed between the brake assembly 17 and the manually opening device 20. The input shaft 20*a* is projected from an end of the lower semi-cylindrical part 10. The shaft 20*a* is connected to a support shaft 17*g* that is fixed at the brake plate 17*d* via a self-rock clutch 20*b*. The rotating force for opening the shutter curtain is transmitted to the output shaft 7 via the brake assembly 17, the motor shaft 12*b* and the first reduction gear 14.

When the lower part 10 accommodating the components is covered by the upper part 9, the upper part 9 slidably engages the lower part 10 by positioning one end of the engaging portion 9*b* of the upper part 9 relative to the other end of the engaging portion 10*b* of the lower part 10. At this stage, the components are temporarily positioned in the lower part 10. A space is presented between the inner surface of the upper part 9 and the upper outer surfaces of the components. The flange 9*c* of the upper part 9 and flange 10*d* of the lower part 10 are spaced apart to form a gap. Then, the gap between the flanges 9*c*, 10*d* is reduced by fastening the upper and lower parts 9, 10 with a plurality of screws 11 to reduce the diameter of the casing formed by the upper and lower parts 9, 10. There exists no play between the components and upper and lower parts so that the upper protruded engaging portions 13*c*, 14*d* are positioned corresponding to the projection 9*a* of the upper part 9.

Fastening further, corner portions L of the protruding portions 13*c*, 13*d*, 15*c*, 15*d* of the first and the second brackets are pressed against corresponding corner portions M of the projections 9*a*, 10*a* of the upper and the lower parts 9, 10. Thus, the first and the second brackets 13, 15 are properly and precisely positioned and the rotation of the brackets is prevented. The precision of alignment of the motor shaft 12*b*, the first reduction gear 14, and drive shaft 7 is achieved. The other components are also fixed by tightening the upper and the lower parts.

A plurality of tapping holes 9*d*, 10*e* are provided on the outer surfaces of the upper and the lower parts 9, 10. The tapping holes 9*d*, 10*e* are outwardly projected from the surfaces and extended in the longitudinal direction of the casing. A plurality of through holes 15*e* are provided in the second bracket 16. The through holes 15*e* are opposed to the tapping holes 9*d*, 10*e*, and the casing 6 and the second bracket 6 are fixed to each other with screws (not shown). When screwing, the cutting dust does not enter inside the casing 6 because the tapping holes 9*d*, 10*e* are provided outwardly in the radial direction of the surfaces.

In accordance with the embodiment, the casing 6 consists of two parts and the components for opening and closing device 2 are installed into the lower part 10, then the upper part 9 is coupled to the lower part 10 by sliding, and the upper and the lower parts 9, 10 are secured to each other. In this regard, the installation efficiency is improved because the electric motor 12, the first reduction gear 14, the drive shaft 7, the brake assembly 17, and manually opening device 20 are merely installed into the lower part 10 having the upper opening.

When the upper part 9 is coupled to the lower part 10 by sliding, there exists the space between the inner surface of the casing 6 and the components 14, 7, 17, 20 even if the inner diameter of the casing 6 is predetermined to have substantially the same dimension of the outer diameter of the components 14, 7, 17, 20. The space is reduced by fastening the flanges 9*c*, 10*d* to each other such that the components are fixed in the casing 6 without having any spaces and play. Therefore, the complicated operations of the prior art such as extending the inner diameter of the casing by heating are eliminated.

The first supporting portion 13*a*, the second supporting portion 13*b*, the first supporting portion 15*a*, and second supporting portion 15*b* of the first and second brackets 13, 15 are opposed to correspond with the opposed location of the upper and lower protruding portions 13*c*, 13*d*, 15*c*, 15*d* that are engaged with the protruding portions 9*a*, 10*a* of the upper and lower parts 9, 10. The motor shaft 12*b*, the gear shaft 14*a*, and the output shaft 7 that are supported by the protruding portions 13*c*, 13*d*, 15*c*, 15*d* are automatically aligned. Process in which the brackets 13, 15 are fixed with through bolts to obtain alignment is eliminated. The positioning of the brackets 13, 15 relative to the casing 6 is properly and precisely achieved by fastening the flanges 9*c*, 10*d* of the upper and lower parts 9, 10.

Figure 10:
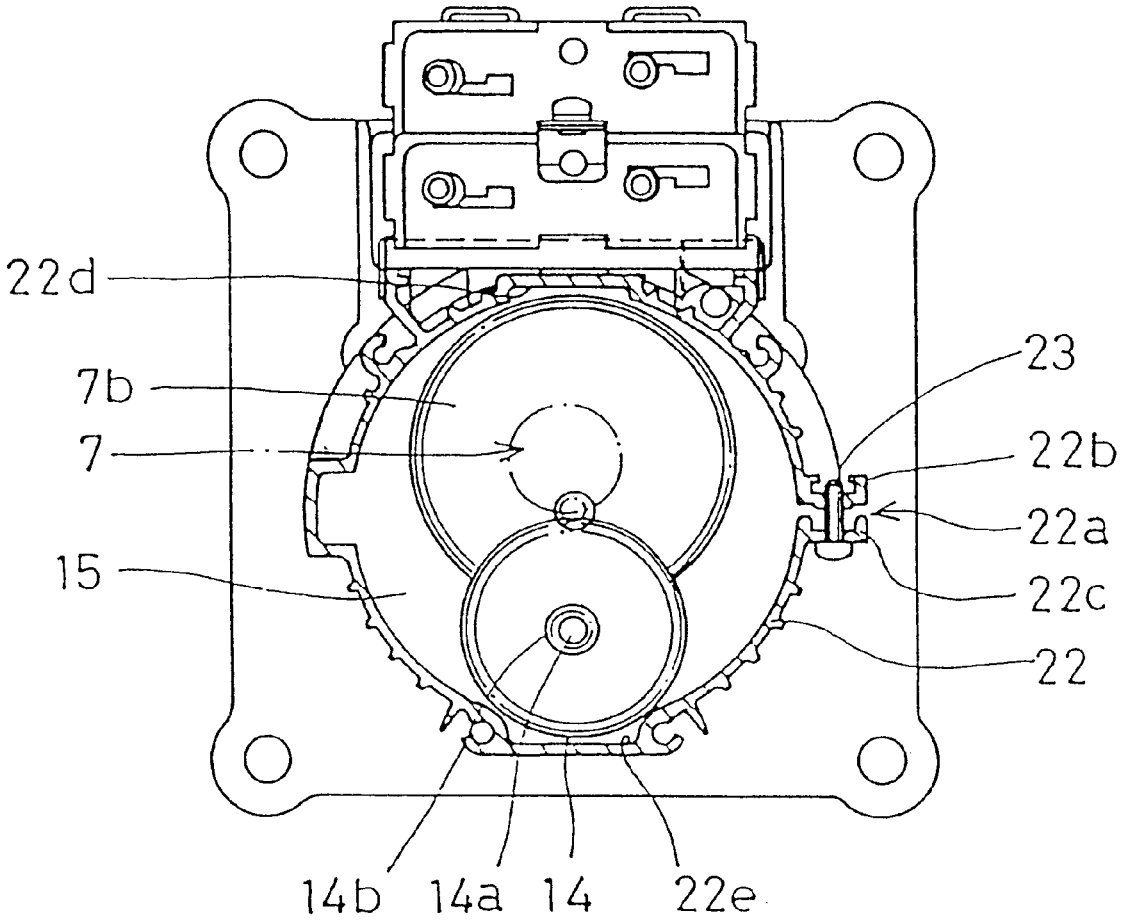
FIG. 10 shows a sectional view of a second embodiment of the present invention.

The casing of the present invention is not limited to the casing 6 of the first embodiment having two divided parts. As is shown in FIG. 10, the casing 22 may consist of a single body having a gap portion 22*a*. In the natural condition, a diameter of the casing is in an expanded state, flanges 22*b*, 22*c* are opposed and spaced apart. From the natural condition, the flanges 22*b*, 22*c* are clamped by screw 23 to reduce the diameter of the casing and fix the components inside the casing. Similar to the first embodiment, the protruding portions 13*c*, 13*d*, 15*c*, 15*d* of the first and the second brackets 13, 15 are engaged with the projections 22*d*, 22*e* provided on the inner surface of the casing 22. Thus, the first and the second brackets 13, 15 are fixed and the rotation of the brackets relative to the casing 22 are prevented.

Figure 11:
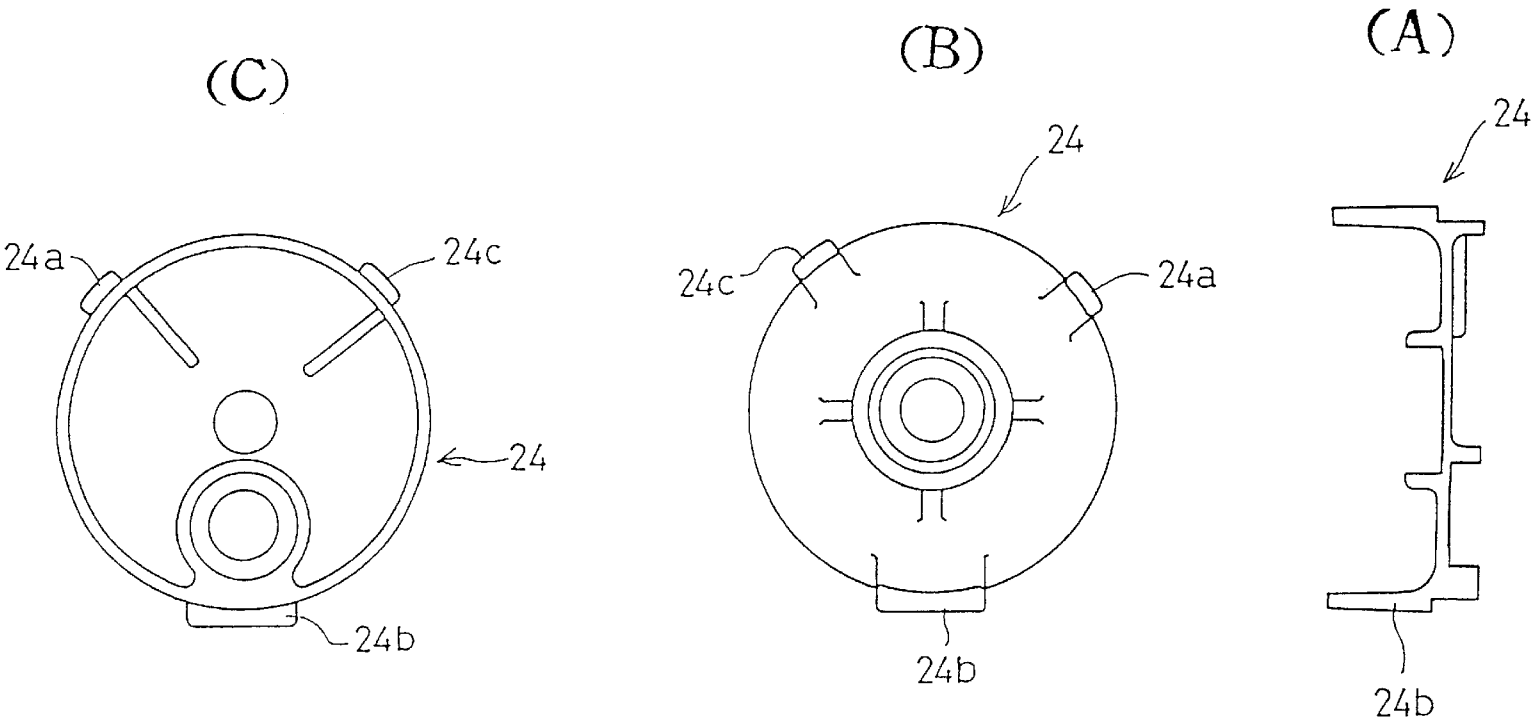
FIG. 11(A) shows a front view of a first bracket of a third embodiment.
FIG. 11(B) shows a right side view of the first bracket of the third embodiment.
FIG. 11(C) shows a left side view of the first bracket of the third embodiment.
Figure 12:
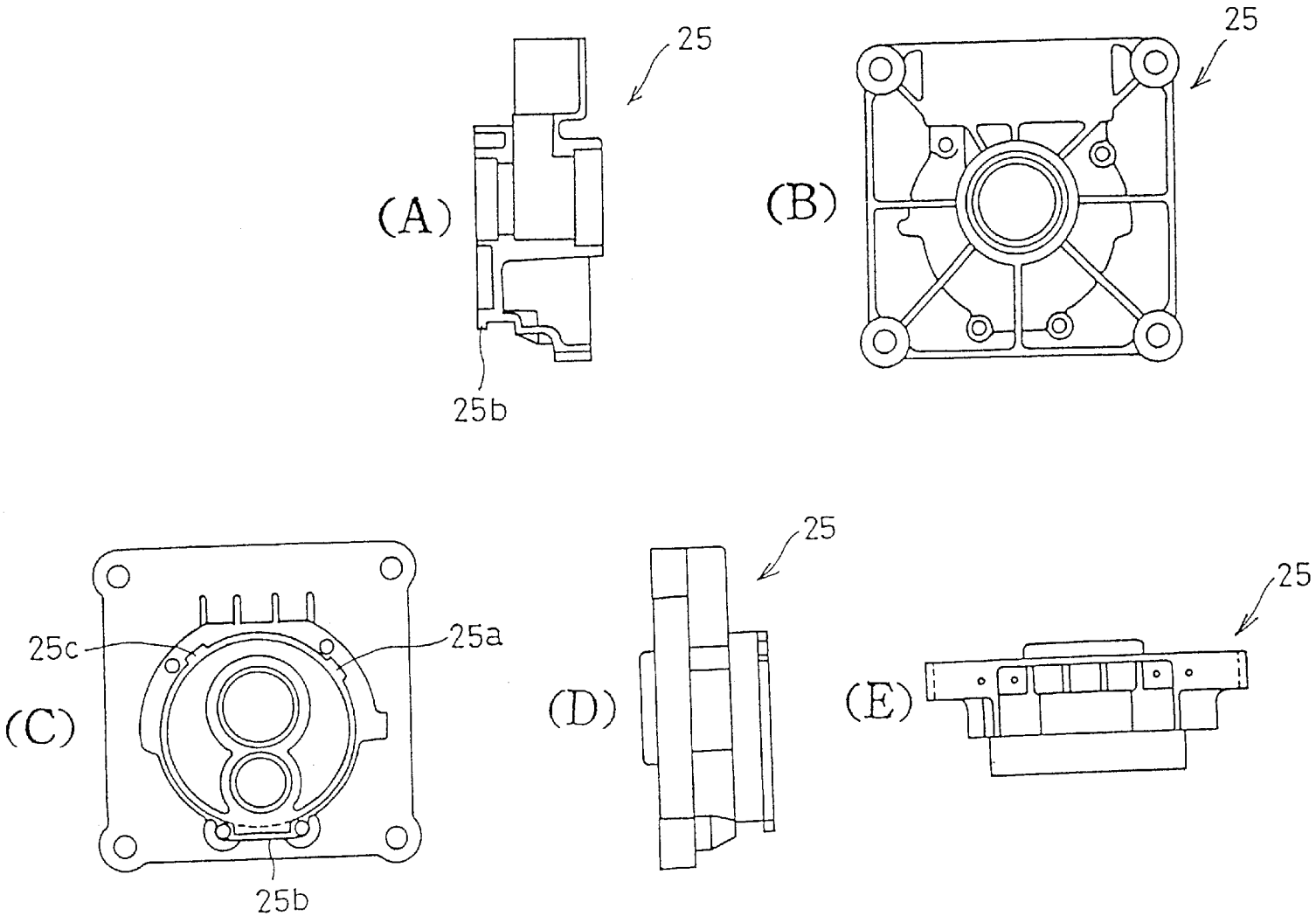
FIG. 12(A) shows a front view of a second bracket of the third embodiment.
FIG. 12(B) shows a right side view of the second bracket of the third embodiment.
FIG. 12(C) shows a left side view of the second bracket of the third embodiment.
FIG. 12(D) shows a back view of the second bracket of the third embodiment.
FIG. 12(E) shows a front view of the second bracket of the third embodiment.
Figure 13:
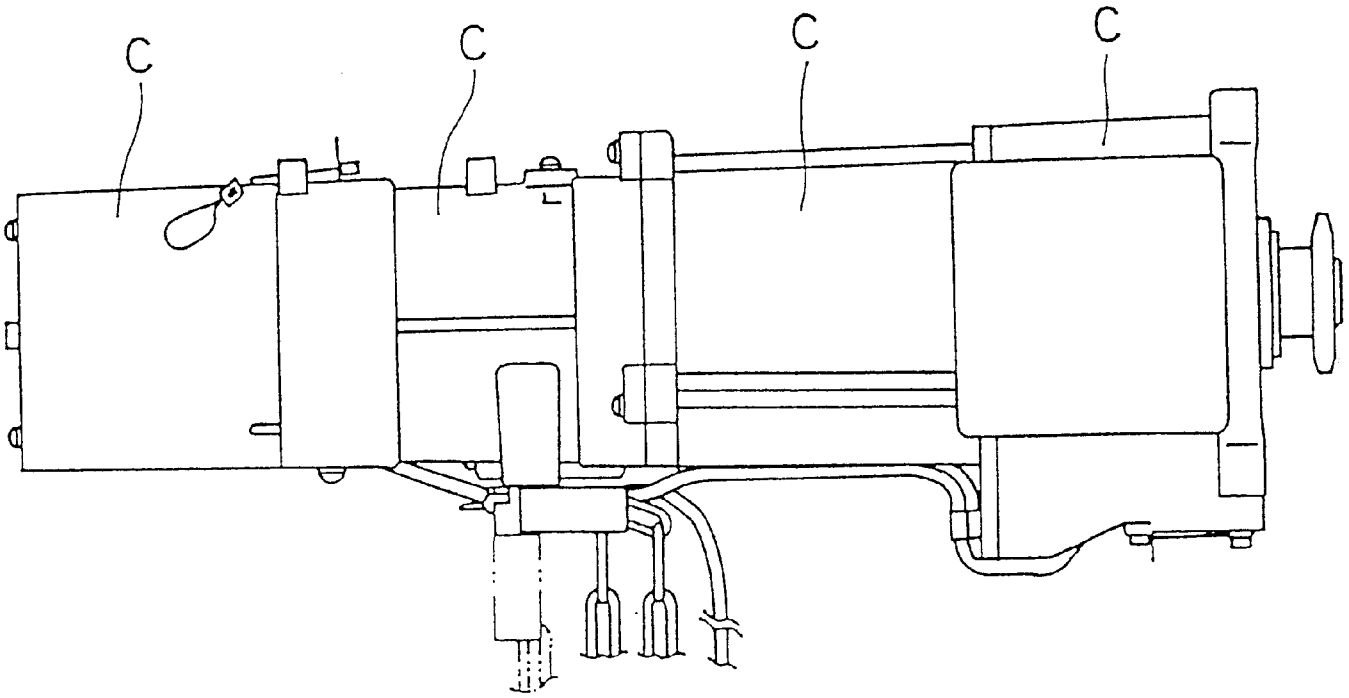
FIG. 13 is a front view showing the drive assembly of the prior art.
Figure 14:
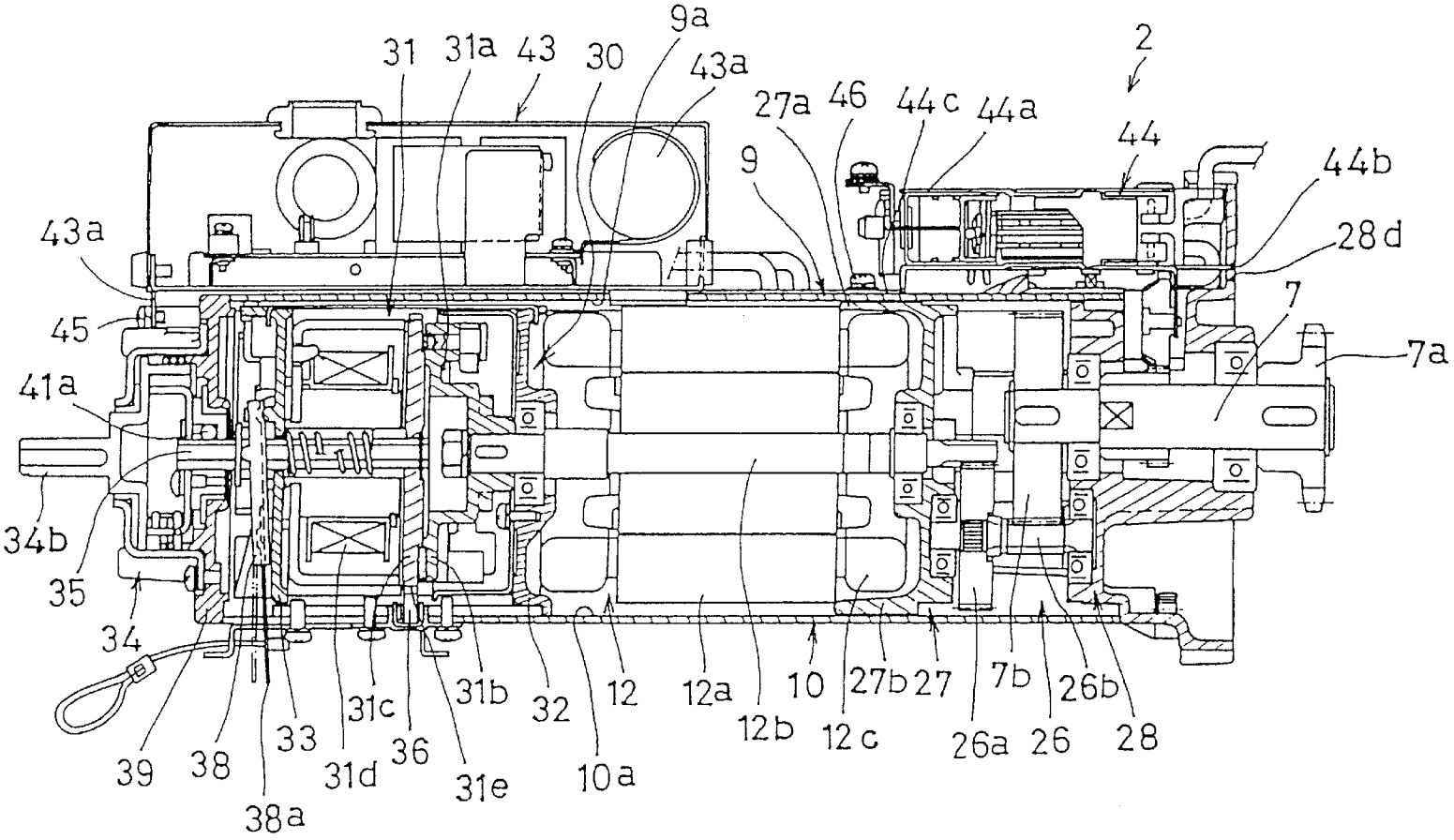
FIG. 14 is a partial sectional view showing the drive assembly of a fourth embodiment.
Figure 15:
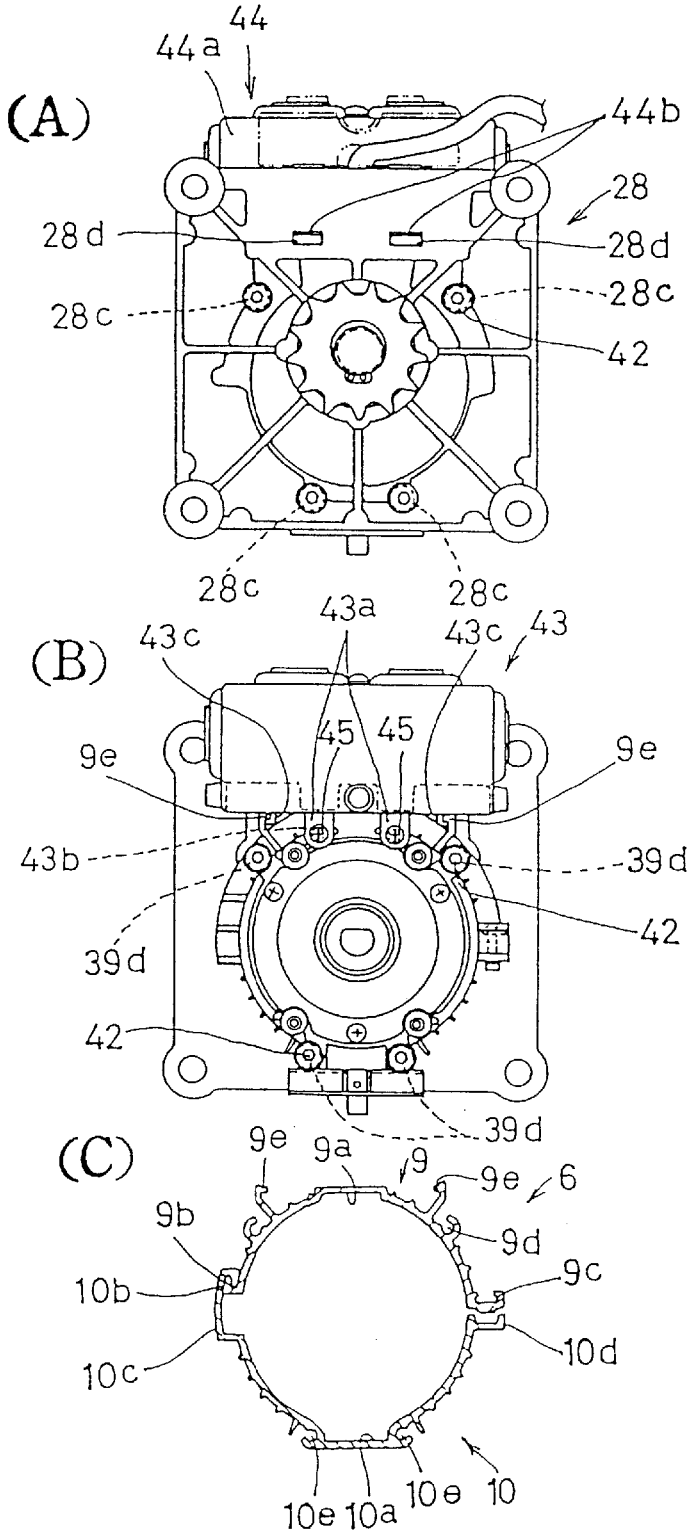
FIG. 15(A) is a right side view of FIG. 14.
FIG. 15(B) is a left side view of FIG. 14.
FIG. 15(C) is a cross sectional view of the casing.
Figure 16:
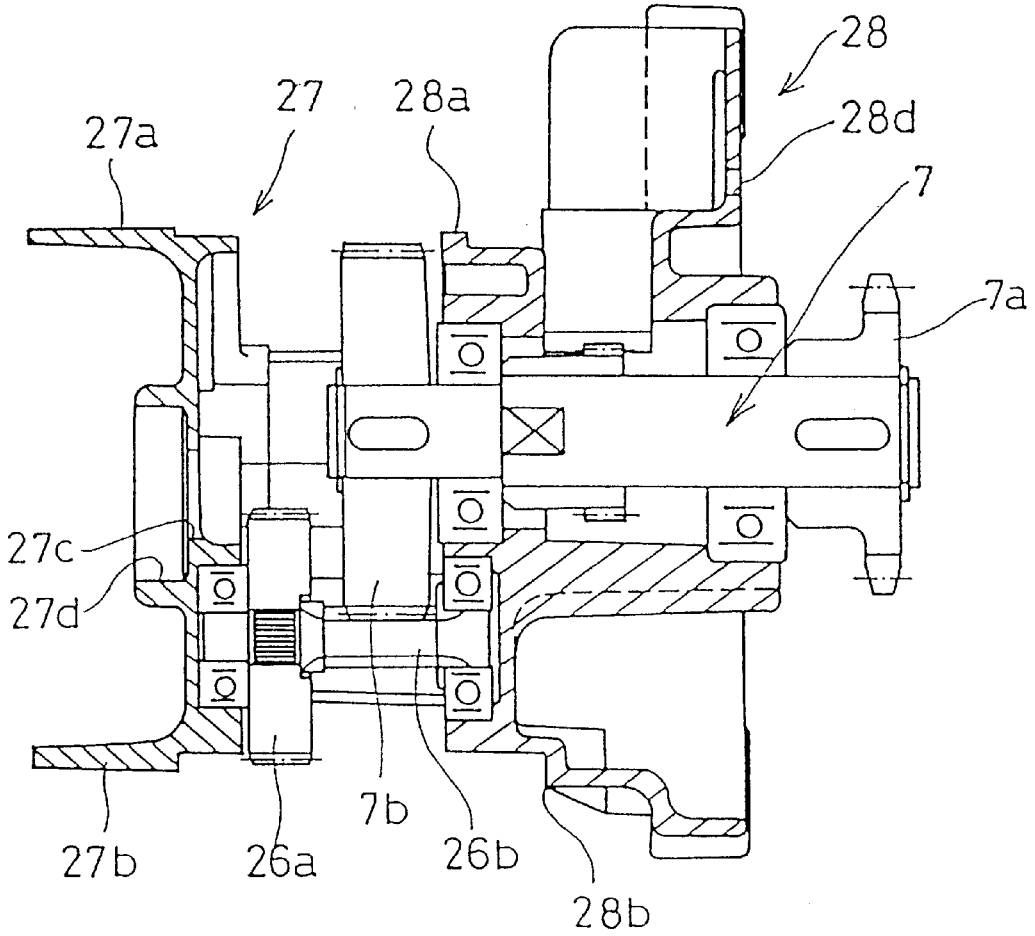
FIG. 16 is a section showing a gear unit of the fourth embodiment.
Figure 17:
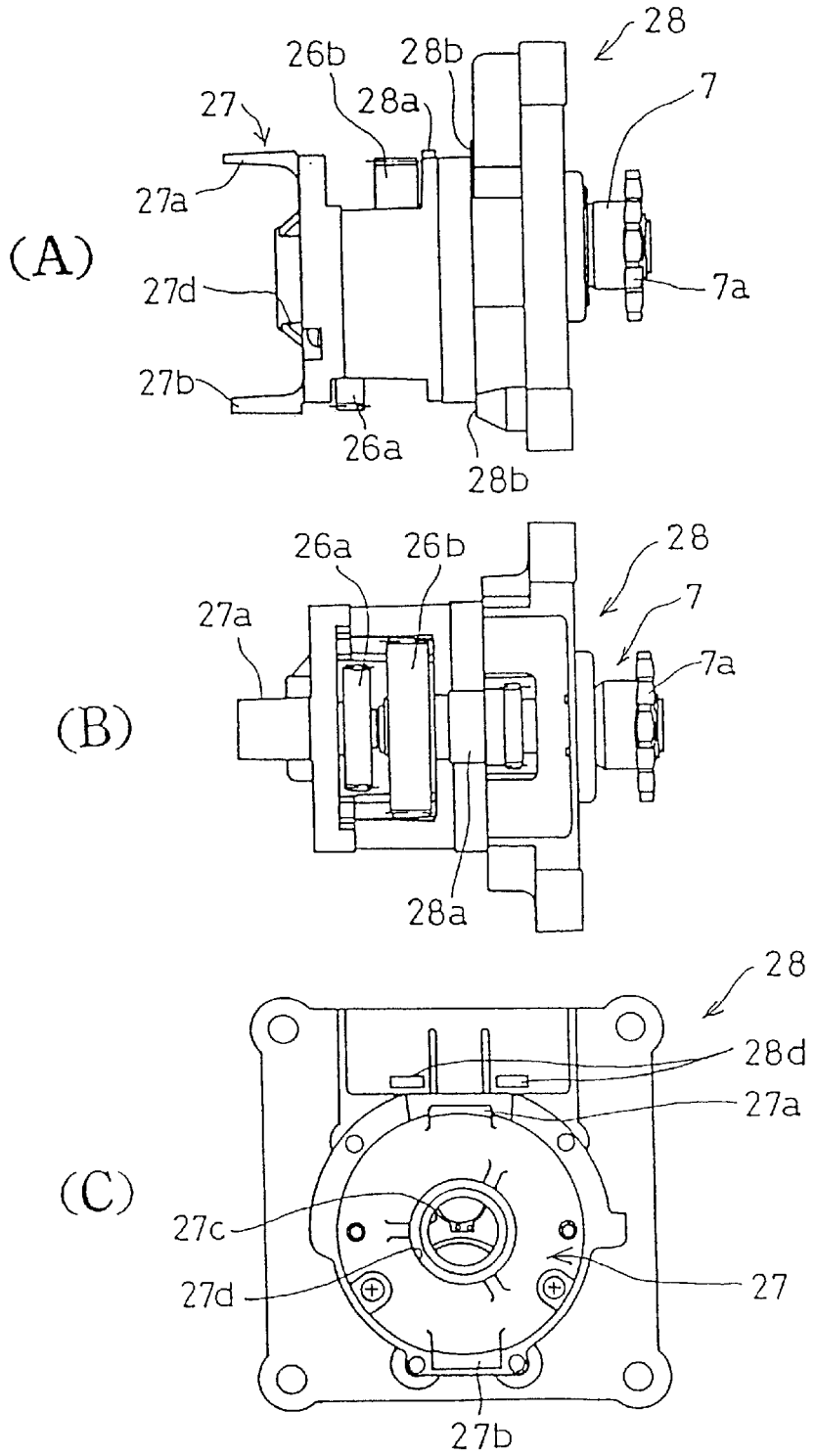
FIG. 17(A) is a front view of the gear unit of the fourth embodiment.
FIG. 17(B) is a plan view of the gear unit of the fourth embodiment.
FIG. 17(C) is a left side view of the gear unit of the fourth embodiment.
Figure 18:
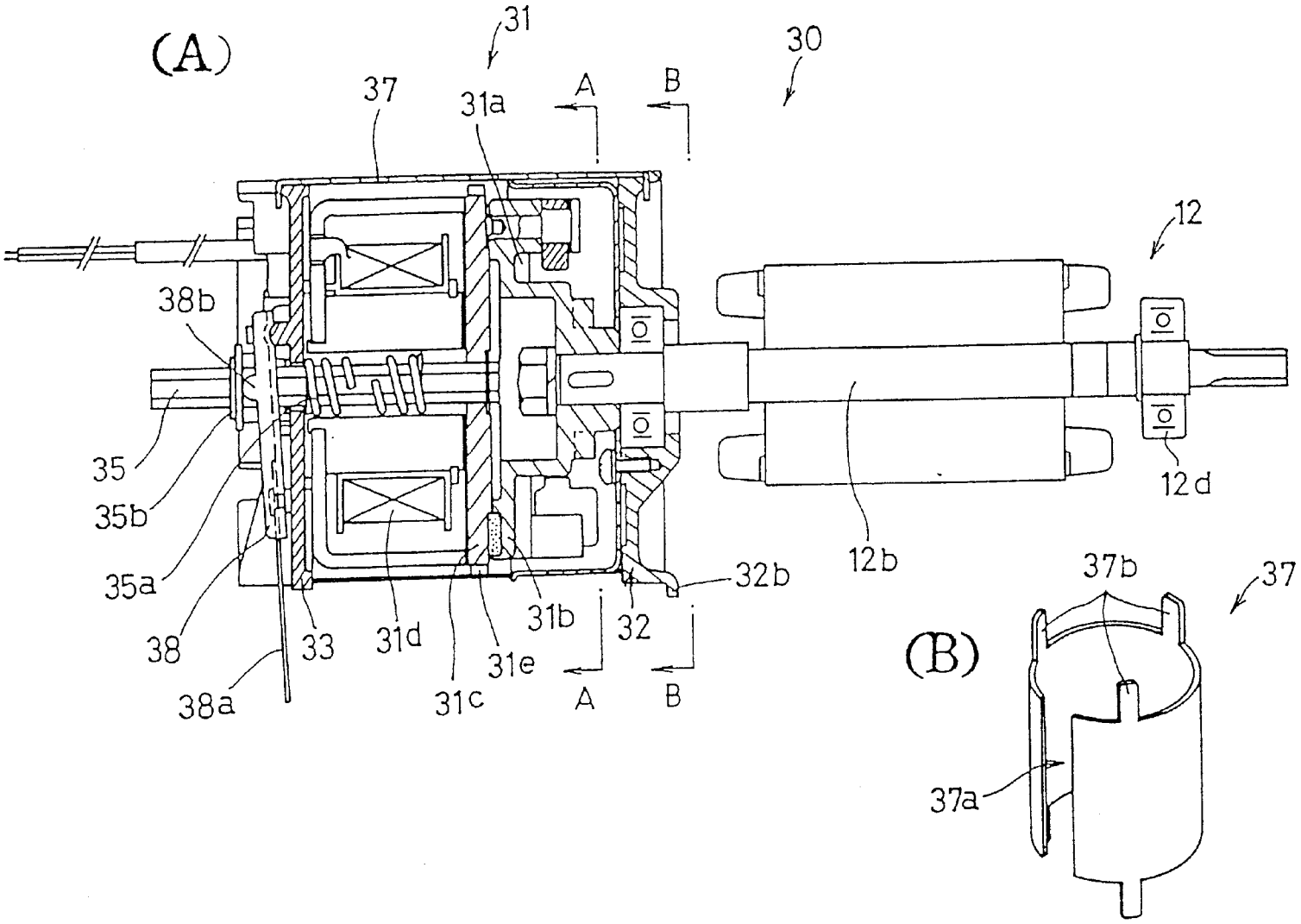
FIG. 18(A) is a front view of a driving unit of the fourth embodiment partially showing a section.
FIG. 18(B) is a perspective view of a unit case.
Figure 19:
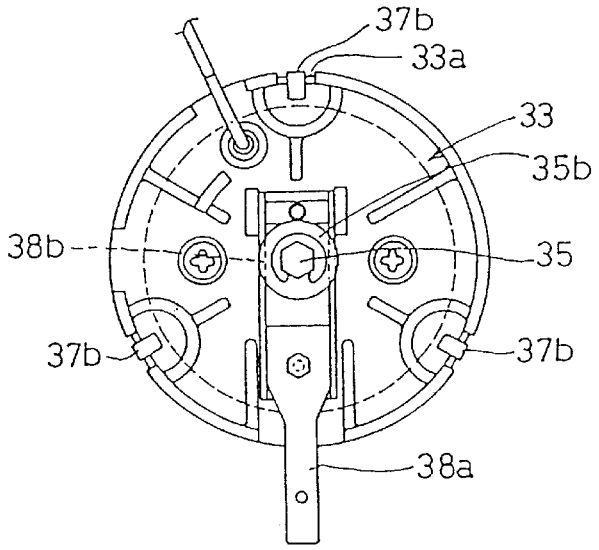
FIG. 19(A) is a right side view of FIG. 18(A)
FIG. 19(B) is a section taken along the line A—A of FIG. 18(A)
FIG. 19(C) is a section taken along the line B—B of FIG. 18(A)
Figure 19:
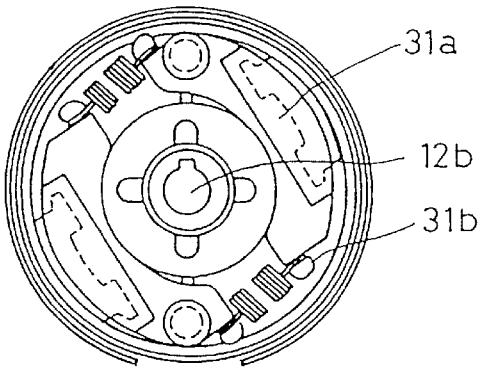
Figure 19:
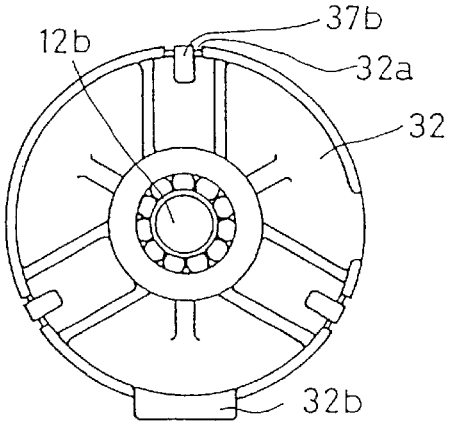
Figure 20:
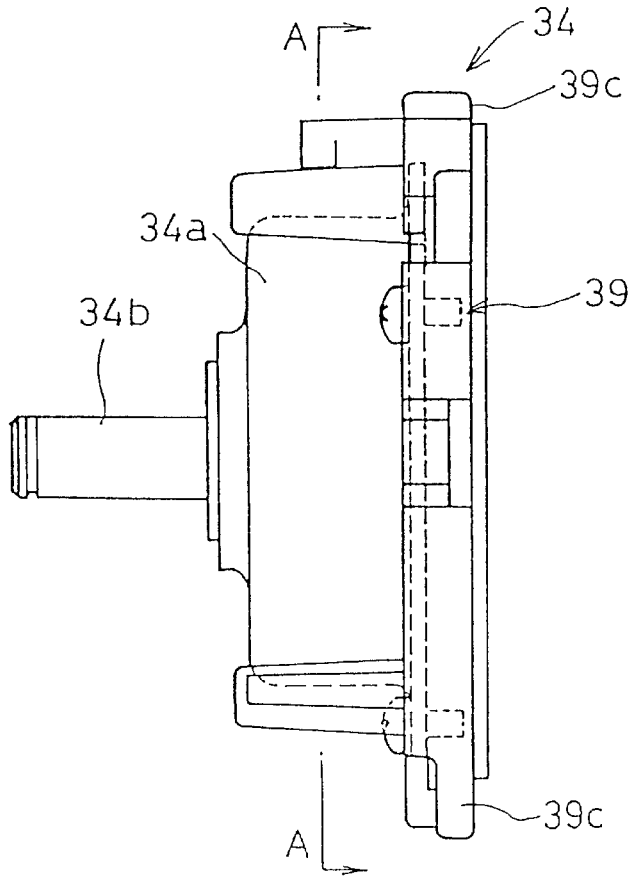
FIG. 20(A) is front view showing a manually operating portion of the fourth embodiment.
FIG. 20(B) is a section taken along the line A—A of FIG. 20(A)
Figure 20:
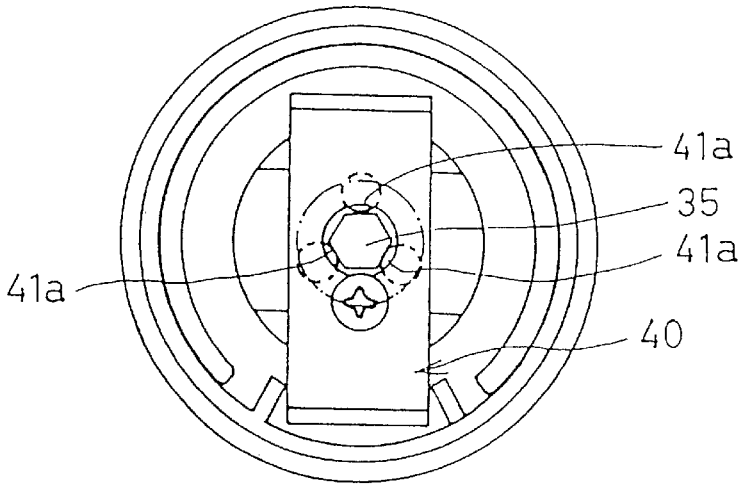
Figure 21:
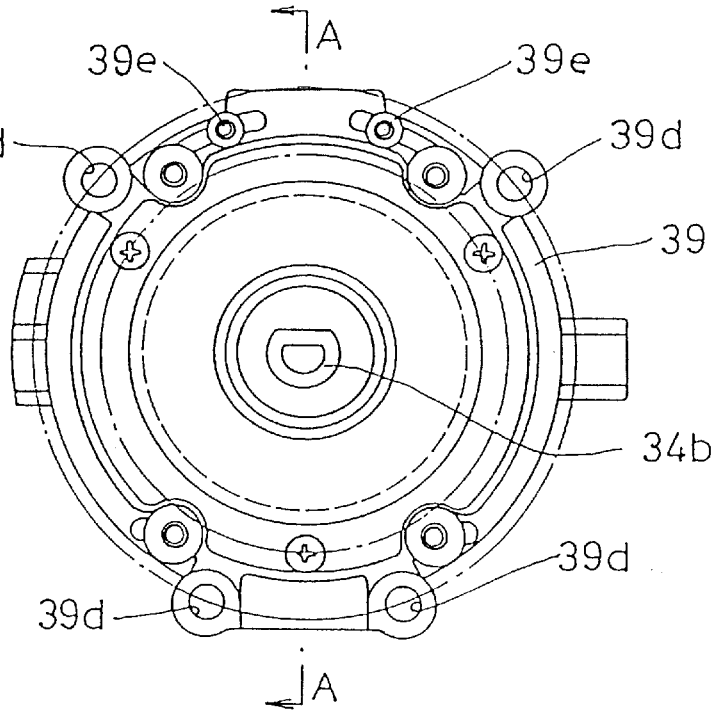
FIG. 21(A) is a left side view of FIG. 20(A)
FIG. 21(B) is a section taken along the line A—A of FIG. 21(A)
Figure 21:
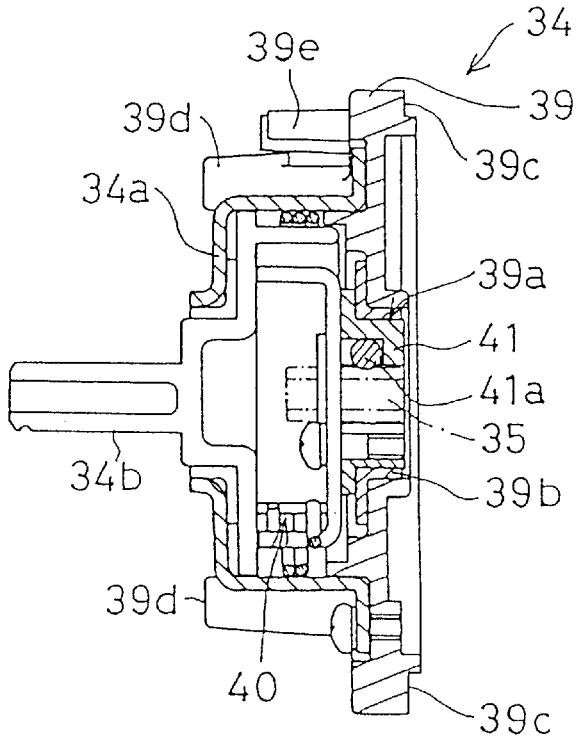

The means for preventing the rotation of the first and the second brackets against the casing is not limited to the first embodiment in which the protruding portions of the brackets are engaged with the projections of the casing. For example, engaging portions inwardly protruding from the surface may be provided in the casing and the engaging portions may engage with cavities provided in the brackets. As shown in FIGS. 11 and 12, three projections 24*a*, 24*b*, 24*c*, 25*a*, 25*b*, 25*c* may be provided on the first and the second brackets 24, 25 along the surfaces so as to fix the surfaces at three points and to prevent the rotation.

A fourth embodiment will be explained based on FIGS. 14 to 20. The same numerals are designated to the common components. The casing 6 is comprised of upper semi-cylindrical part 9 and the lower semi-cylindrical part 10. According to the fourth embodiment, firstly, the upper part 9 and the lower part 10 are engaged to each other to form a generally cylindrical casing with a spacing between the upper and the lower parts. More specifically, the engaging portion 9*b* of the upper part 9 and the engaging portion 10*d* of the lower portion 10 are engaged and the flange portions 9*c*, 10*d* are temporarily secured with a screw 11. Then, the components such as the electric motor 12 are installed into the generally cylindrical casing 6 and securing the screw 11. The components are comprised of a unit having the outer diameter corresponding to the inner diameter of the casing 6. The unit is positioned and fixed by contacting the inner surface of the casing. A gear unit 26*a* that is mounted in one end of the casing 6 comprises a first bracket 27, a second bracket 28, a first reduction gear 26*b*, and an output shaft 7 having a second reduction gear 7*b*. The first and the second brackets 27, 28 have an outer diameter that is substantially the same as an inner diameter of the casing 6. The construction of the first bracket 27 is substantially the same as that of the first embodiment. The first bracket 27 has engaging projections 27*a*, 27*b* that engage the projections 9*a*, 10*a* of the upper and the lower parts 9, 10 so that the first bracket 27 is positioned and the rotation of the bracket 27 is prevented. The second bracket 28 has an engaging projection 28*a* that engages the projection 9*a* of the upper part 9 so that the second bracket 28 is positioned and the rotation of the bracket 28 is prevented. The second bracket 28 has a contacting surface 28*b* that outwardly contacts the edge of the casing 6. When the gear unit 26 is installed in the casing 6 from one end of the casing 6, the positioning of the gear unit 26 in the axial direction is obtained by inserting the second bracket 28 into the casing 6 until the contacting surfaces 28*b* contacts the edge of the casing 6.

Though the motor 12 of the preceding embodiment has the stator core 12*a* the outer diameter of which is substantially the same as that of the motor shaft 12*b*, the stator core 12*a* of the present embodiment is of a unit (stator core unit 12*a*) that is separated from the rotor core integrated with the motor shaft 12*b* and is installed in the casing 6.

A driving unit 30 includes the motor shaft 12*b* constituting a rotor core and a reduction device 31 having a governor 31*a* being connected to the motor shaft 12*b*. The reduction device 31 is installed via a third bracket 32 by which the motor shaft 12*b* is journalled and via a fourth bracket 33. The basic construction of the reduction device 31 is generally the same as that of the first embodiment. The reduction device 31 comprises a first braking plate 31*b* connecting to the motor shaft 12*b*, a second braking plate 31*c* contacting the first braking plate, a solenoid 31*d* which releases the brake by changing from the non-magnetized state to the magnetized state, a hex shaft 35 one end of which is integrally connected to the second brake plate 31*c*, and the other end of which is projected through the fourth bracket 33 to a manually operating unit 34, and so forth. Ratchet teeth 31*e* formed on the second brake plate 31*c* engage a ratchet 36 formed on the lower part 10 so as to prevent the rotation in the direction of closing the shutter curtain 1. Thus, when the electric motor 12 is driven, the brake is released so that opening and closing operations are obtained by the motor. When the motor 12 is not driven, the brake is engaged so that the rotation of the motor shaft 12*b* in the closing direction is prevented.

A unit case 37 is adapted to cover an outer surface between the third and fourth brackets 32, 33. The unit case 37 has an outer diameter that is substantially the same as an inner diameter of the casing 6 in the fastened state. The unit case 37 has a generally cylindrical shape in which a gap portion 37*a* is provided in the lower portion. Claws 37*b* are provided at each end portion and the claws 37*b* are positioned corresponding to the engaging concave portions 32*a*, 33*a* that are provided on outer surfaces of the third and fourth brackets 32, 33. The unit case 37 is coupled to the brackets 32, 33 by bending the claws 32*a*, 33*a* into the inner direction to engage the engaging concave portions 32*a*, 33*a* and to prevent rotation of the case 37 relative to the brackets 32, 33. The third bracket 32 has an engaging convex portion 32*b* that engages the protruding portion 10*a* of the lower part 10 so that the rotation of the driving unit 30 covered by the case 37 relative to the casing 6 is prevented. The case 37 also prevents the brackets 32, 33 from misaligning in the axial direction so that a brake gap between the first and second brake plates 31*b*, 31*c* can easily be managed.

A release lever 38 is adapted to release a brake mechanism 31. The release lever 38 has a front portion that is pivotally connected to the fourth bracket 33 and a base portion that is connected to an operating plate 38*a*. The plate 38*a* is pulled via an operating cord against a spring 35*a* that is provided on the hex shaft 35. A protruding portion 38*b* that is provided at an intermediate portion of the release lever 38 pushes a washer 35*b* that is integrally provided on the hex shaft 35. Thus, the second brake plate 31*c* is apart from the first brake plate 31*b* to release the brake.

The manually operating unit 34 is provided at the end of the casing 6. The manually operating unit 34 comprises a fifth bracket 39 that has a through hole 39*a* therein for freely receiving the end of the hex shaft 35, a case body 34*a* that is fixed to the other side of the fifth bracket 39, and an input shaft 34*b* that is housed in a space defined by the fifth bracket 39 and the case body 34*a* and is operably connected to the base portion of the hex shaft 35 via a self-rock clutch 40. The manually operating unit 34 has an outer diameter at one end that is substantially the same as an inner diameter of the fastened casing 6. The input shaft 34*b* is connected to a manually operating device such as a chain wheel, by which the input shaft 34*b* can be rotated. Similar to the first embodiment, the opening operation of the shutter curtain 1 can be obtained in case of the electric failure.

The hex shaft 35 can be moved to the other end in the axial direction to release the brake mechanism 31 with the operation of release lever 38. The fifth bracket 39 receiving the hex shaft 35 is constructed as follows. A guide 41 is provided at the through hole 39*a* via a bearing 39*b*. Three bearing balls 41*a* are rotatably internally provided in the guide 41. When the hex shaft 35 is inserted in the guide 41, the balls 41*a* contact the side surfaces of the shaft 35. While the shaft 35 can be rotated together with the guide 41, the shaft 35 can smoothly moved in the axial direction with the rotation of the balls 41*a*.

A contacting portion 39*c* is provided at the outer edge of the fifth bracket 39. The contacting portion 39*c* is positioned to contact and cover the other end of the casing 6. Sizes of outer diameters of units 26, 12*a*, 30, 34 are predetermined to be substantially the same as the inner diameter of the casing 6 in the fastened state. The units 26, 12*a*, 30, 34 are installed into the casing 6 as follows.

First, the upper part 9 and the lower part 10 are incorporated to each other to form a generally cylindrical casing 6 in which the casing 6 is in an expanded state by temporarily fastening the bolt 11. Then, the gear unit 26 is installed from one end of the casing 6. The gear unit 26 is to be positioned inside the casing 6 in the axial direction by contacting the contacting portion 28*b* of the second bracket 28 with the end portion of the casing 6. Next, the stator core unit 12*a* is installed from the other end of the casing 6. The stator core unit 12*a* is to be positioned inside the casing 6 by contacting the one outer edge portion of the stator iron-core 12*c* of the stator core 12 with the other edge portion of the protruding portions 27*a*, 27*b* provided on the first bracket 27 of the gear unit 26. Next, the driving unit 30 is installed from the other end of the casing 6. The driving unit 30 is to be positioned by engaging the bearing 12*d* provided at the front end of the motor shaft 12*b* with bearing receiving portion 27*d* provided adjacent the through hole 27*c* of the first bracket 27. The positioning of driving unit 30 in the radial direction is obtained by engaging the protruding portion 32*a* of the third bracket 32 with the protruding portion 10*a* of the lower part 10. Finally, the manually operating unit 34 is installed by engaging the base portion of the hex shaft 35 with the guide 41 of the fifth bracket 39. The operating unit 34 is to be positioned in the axial direction by contacting the contacting portion 39*c* of the fifth bracket 39 with the other end of the casing 6.

After incorporating the units 26, 12*a*, 30, 34 into the casing 6, the inner diameter of the casing 6 is reduced by further fastening the bolt 11 that is temporarily loosely provided in the upper and lower parts 9, 10. The units 26, 12*a*, 30, 34 are aligned and fixed without rotating by confining with the internal surface of the casing 6. Four bolt receiving holes 28*c* are provided in the second bracket 28 in which the holes 28*c* are opposed to the tapping holes 9*d*, 10*e* of the upper and lower parts 9, 10. Through holes 39*d* are provided in the fifth bracket 39 in which the holes 39*d* are opposed to the tapping holes 9*d*, 10*e*. Elongate bolts 42 are inserted from the through holes 39*d* to the bolt receiving holes 28*c* via the tapping holes 9*d*, 10*e*, and an external threaded portion provided at the front end of the bolt 42 is threaded to the bolt receiving holes 28*c*. Accordingly, the units 26, 12*a*, 30, 34 are positioned in the axial direction and fixed. According to this embodiment, before incorporating the units 26, 12*a*, 30, 34, the upper and lower parts 9, 10 are temporarily engaged to each other in which the casing 6 is in the expanded state (A space is presented between the upper and lower parts 9, 10). By further fastening the bolt 11, the outer surfaces of the units 26, 12*a*, 30, 34 are confined by the internal surface of the casing 6 such that the units 26, 12*a*, 30, 34 are fixed without rotating and precisely centralized.

A controller for the electric motor 2 may be integrally provided in the electric motor 2. According to the embodiment, a condenser 43*a*, control panel 43 including a circuit for controlling opening and closing operations, and a limit switch 44 detecting the upper and lower limits of the shutter curtain 1 are provided above the driving assembly 2.

The control panel 43 is provided at the end of the casing 6. Downwardly extending protrusions 43*a* are provided at the end of the control panel 43. Through holes 43*b* are provided in the protrusions 43*a* in which the holes 43*b* are opposed to bolt receiving holes 39*e* provided in the fifth bracket 39. Engagement receiving portions 43*c* are integrally provided at the radial edges in which a pair of engagement portions 9*e* integrally provided at the upper portion of the upper part 9 slidably engage the receiving portions 43*c*. The control panel 43 is installed at the casing 6 by inserting bolts 45 from the through holes 43*b* into thread with receiving holes 39*e* of the fifth bracket.

The limit switch 44 comprises a casing 44*a*. Protrusions 44*b* are provided at one end of the lower surface of the casing 44*a*. Bolt securing portions 44*c* are provided at the other end of the lower surface of the casing 44*a*. The protrusions 44*b* are engaged with engagement holes 28*d* that are provided at the upper portion of the second bracket 28. The bolt securing portions 44*c* are fixed to the upper part 9 by threading bolts 46.

Figure 22:
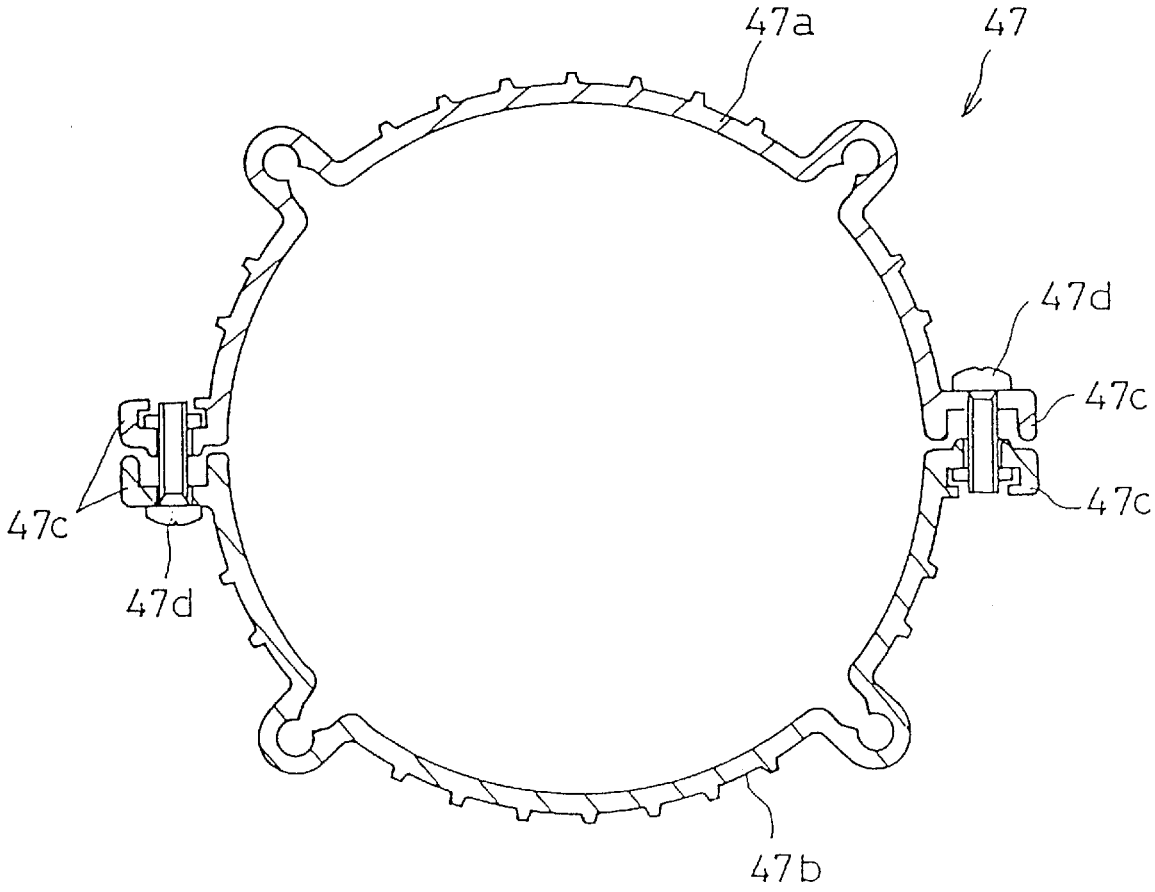
FIG. 22 is a cross section of the casing of another embodiment.

FIG. 22 shows another embodiment of the casing in which both opposed edge portions are fastened. The casing 47 are comprised of the identical semi cylindrical parts 47*a*, 47*b*. Openings of the upper and lower parts 47*a*, 47*b* are opposed to each other. The upper and lower parts 47*a*, 47*b* are engaged at flange portions 47*c*, 47*d* with bolts 47*d*.

Figure 23:
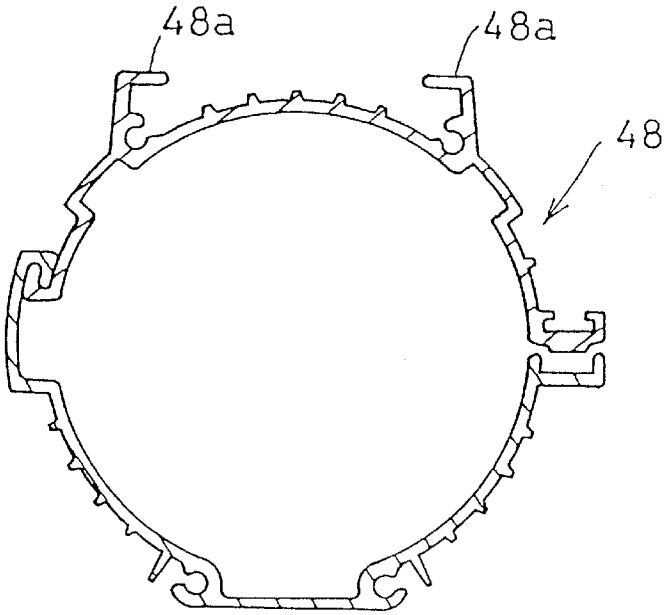
FIG. 23(A) is a cross section of the casing of another embodiment.
FIG. 23(B) is a cross section of the casing of another embodiment.
Figure 23:
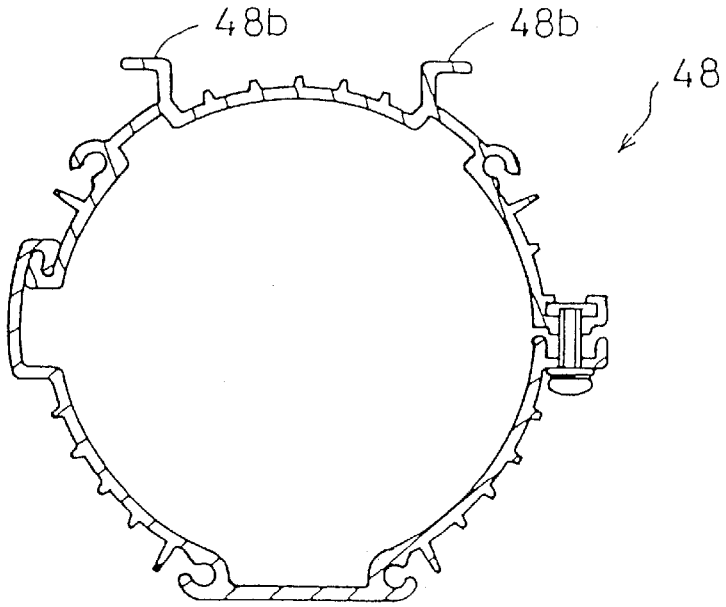
Figure 24:
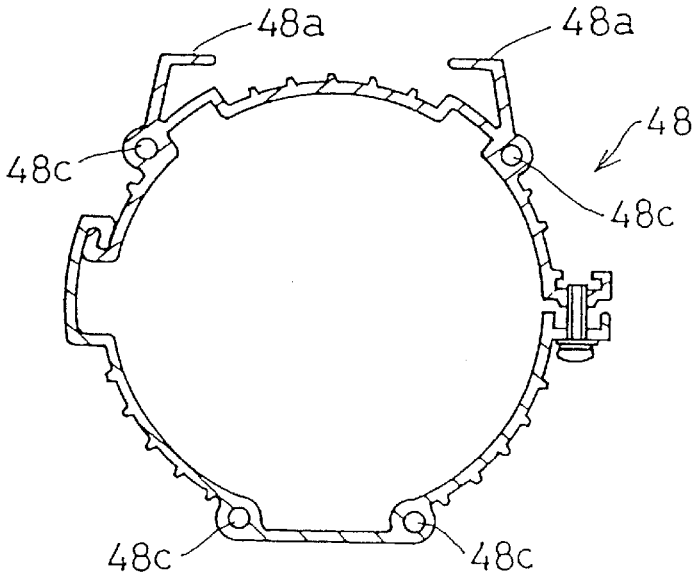
FIG. 24(A) is a cross section of the casing of another embodiment.
FIG. 24(B) is a cross section of the casing of another embodiment.
Figure 24:
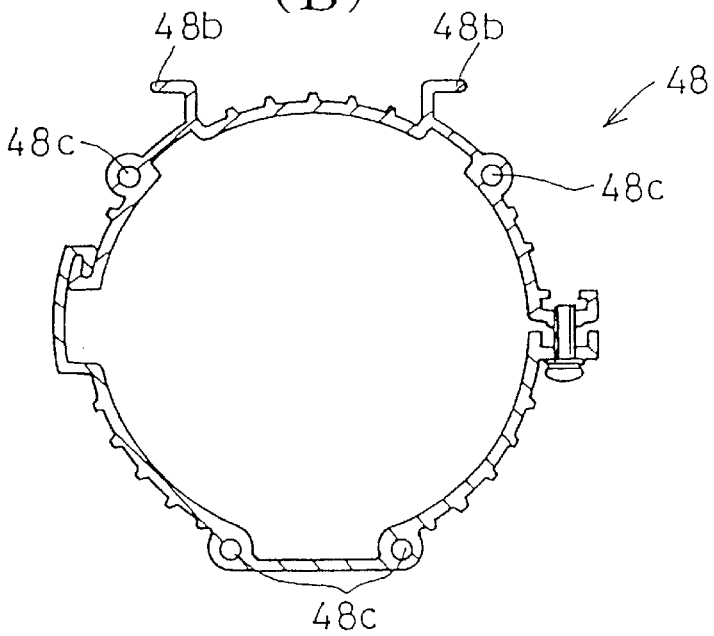
Figure 25:
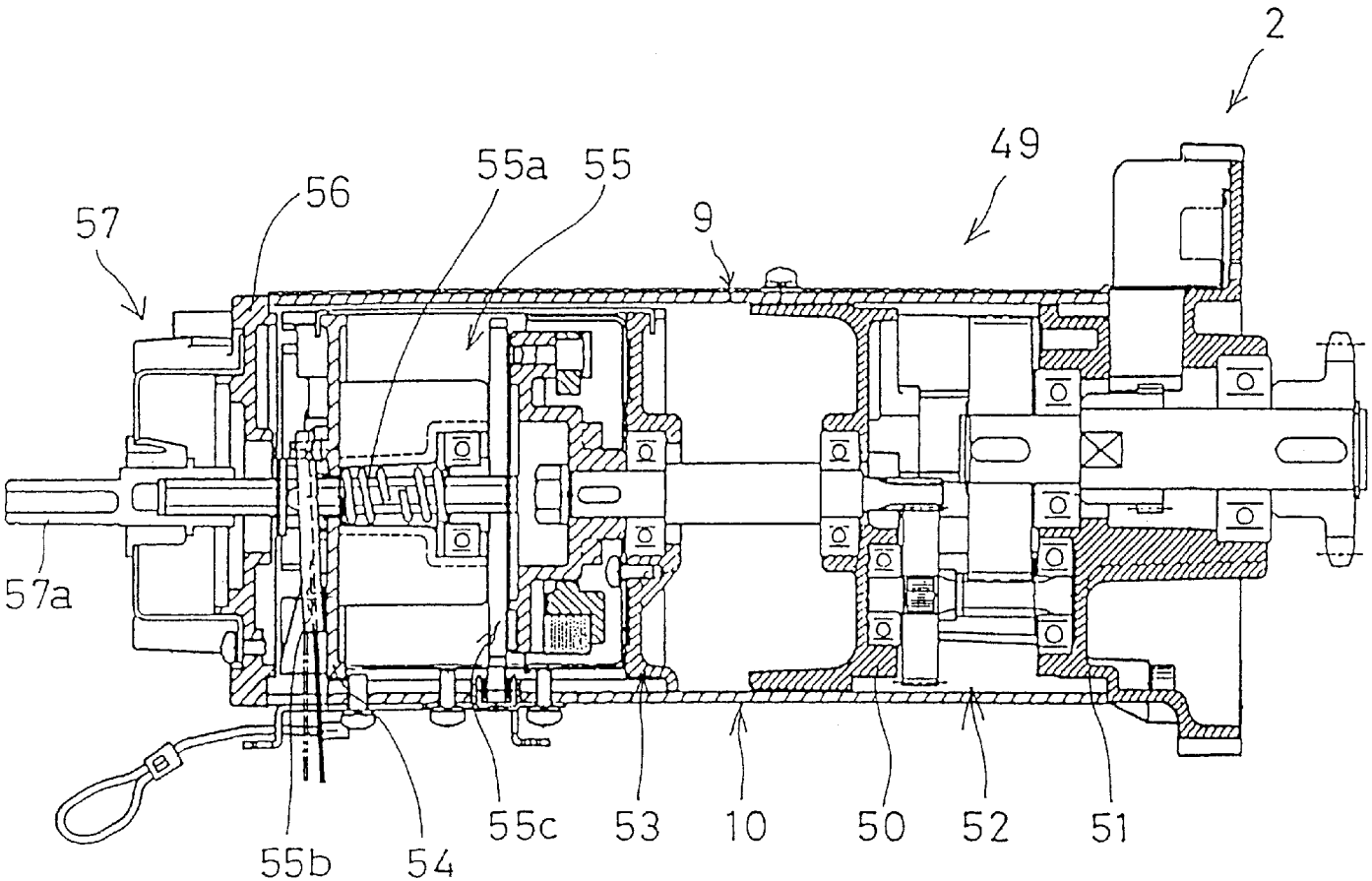
FIG. 25 is a front view of the drive assembly of the fifth embodiment partially showing section.

FIGS. 23, 24 show other embodiments of the casing. An upper semi-cylindrical part 48 may comprise inwardly opposed protrusions 48*a* for incorporating the control panel (FIG. 23(A), FIG. 24(A)). The upper part 48 may comprise outwardly extended protrusions 48*b*(FIG. 23(B), FIG. 24(B)). The casing may comprise tapping holes 48*c* without a cutout (FIG. 24(A), (B)). With the tapping holes 48*c*, the front end of the through bolts is extended outside via the tapping holes and the fifth bracket, and nuts may be threaded onto the extended portion of the bolts.

The drive assembly may be manually driven in which a casing 49 has a shorter longitudinal dimension. The shortened casing 49 can easily be obtained by the extrusion. The casing 49 accommodates a gear unit 53 with a first and second brackets 50, 51, a driving unit 55 with a third and fourth. brackets 53, 54, and a manually operation unit 57 with a fifth bracket 56. The driving unit 55 is normally in a brake-engaged state by a spring 55*a*. The driving unit 55 comprises a brake apparatus 55*c* that is released by the operation of a release lever 55*b* and a transmission shaft 55*d* that transmits power to the gear unit 52. The shutter curtain 1 is opened by rotating an input shaft 57*a* of the manually operating unit 57 in an opening direction. The shutter curtain 1 is closed under its own weight by the operation of the release lever 55*b*.

Industrial Applicability

The drive assembly of the present invention permits efficient incorporation of the components into the casing. The present drive assembly is preferably adapted to the architectural rolling door.

What is claimed:

1. A drive assembly for opening and closing a rolling door comprising:

(a) a generally cylindrical casing housing drive assembly components therein, said components including a driving unit, a transmission unit coupled to the driving unit and a plurality of brackets within the casing, said brackets configured to support the driving unit and transmission unit within said casing, said casing having an inner contour;

(b) each bracket being structurally independent of said casing, having an outer contour which corresponds in size and shape to an inner contour of said casing;

(c) said casing having spaced-apart, opposed edge portions extending lengthwise of the cylindrical casing, said opposed edge portions defining a gap portion therebetween; and (d) fasteners spanning the gap portion between the opposed edge portions, said fasteners operable to close the gap portion between the opposed edge portions such that said drive assembly components are brought into alignment with each other and secured inside the casing by the narrowing of said gap portion by the fasteners.

2. The drive assembly as claimed in claim 1 wherein the casing is comprised of a pair of generally semi-cylindrical parts each having a pair of opposed edge portions, and wherein one opposed edge portions are detachably engaged to constitute an engaging part, and wherein the other opposed edge portions constituting the gap portion.

3. The drive assembly as claimed in claim 2 wherein said one opposed edge portions are slidably engaged to each other in the longitudinal direction of the casing.

4. The drive assembly claimed in claim 1, wherein the opposed edge portions defining the gap portion have flanges extending outwardly in the radial direction, and wherein the fasteners for narrowing the gap portion are provided in the flanges.

5. The drive assembly as claimed in claim 1, wherein the drive assembly is comprised of a plurality of units which have substantially the same outer diameter as an inner diameter of the casing.

6. The drive assembly as claimed in claim 5, wherein the units are engaged to each other and installed in the casing.

7. The drive assembly as claimed in claim 1 wherein:

(a) the driving unit comprising drive shaft;

(b) the transmission unit comprising a gear shaft having a reduction gear and an output shaft;

(c) the plurality of brackets comprising:

a first bracket which journals the drive shaft and one end of the gear shaft, and a second bracket which journals the output shaft and the other end of the gear shaft, the external diameters of the both brackets being substantially the same as the internal diameter of the casing; and (d) the drive shaft, the gear shaft and the output shaft being placed into alignment by reducing the diameter of the casing.

8. The drive assembly as claimed in claim 1, wherein the brackets have protruding portions in outer surfaces and the casing has grooves engaging the protruding portions, and wherein the first and the second brackets are temporarily positioned by the engagement of the protruding portions and the grooves, and wherein shafts are brought into alignment by reducing the diameter of the casing.

9. The drive assembly as claimed in claim 1 wherein said driving unit includes an electric motor.

10. The drive assembly as claimed in claim 9 wherein said motor has substantially the same outer diameter as an inner diameter of the casing.

11. The drive assembly as claimed in claim 1 wherein said driving unit is manually driven.

12. The drive assembly as claimed in claim 1 wherein said driving unit includes a drive shaft, and said transmission unit includes a gear shaft and an output shaft.

13. A drive assembly for opening and closing a rolling door comprising:

(a) a generally longitudinal casing sized and shaped for housing drive assembly components therein, said components including a driving unit and a transmission unit coupled to the drive unit, (b) a plurality of removable brackets positionable within said casing and configured to mate with the driving unit and transmission unit for supporting the driving unit and transmission unit within said casing, (c) said casing having spaced apart opposed edge portions extending longitudinally along the length of the casing to define a gap therebetween; and (d) fasteners spanning the gap between the longitudinally extending, opposed edge portions, said fasteners operable to close the gap between the opposed edge portions such that a clamping force is imposed on said bracket so that the driving unit and transmission unit components are brought into alignment with each other and secured inside the casing by the narrowing of the longitudinal gap by the fasteners.

14. The drive assembly as claimed in claim 13, wherein the casing is comprised of a pair of generally semi-cylindrical halves each having a pair of opposed edge portions, and wherein the corresponding opposed edge portions of the two casing halves are detachably engageable to constitute an engaging part, and wherein the other opposed edge portions of the casing halves constituting the gap.

* * * * *